US007300292B2

(12) United States Patent
Nagata

(10) Patent No.: US 7,300,292 B2
(45) Date of Patent: Nov. 27, 2007

(54) JACK TYPE CONNECTOR WITH A SHUTTER, AND PLUG TYPE CONNECTOR

(75) Inventor: Takayuki Nagata, Higashiosaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 0 days.

(21) Appl. No.: 10/187,972

(22) Filed: Jul. 3, 2002

(65) Prior Publication Data

US 2003/0013333 A1 Jan. 16, 2003

(30) Foreign Application Priority Data

Jul. 13, 2001 (JP) ..... 2001-213537
Jul. 19, 2001 (JP) ..... 2001-219700

(51) Int. Cl.
*H01R 13/44* (2006.01)

(52) U.S. Cl. ..... 439/141

(58) Field of Classification Search ..... 439/181, 439/140, 141, 138
See application file for complete search history.

(56) References Cited

U.S. PATENT DOCUMENTS 4,146,291 A * 3/1979 Goff et al. ..... 439/90
4,847,711 A * 7/1989 Inoue ..... 360/96.5
5,035,633 A * 7/1991 Kobayashi et al. ..... 439/140
5,167,516 A * 12/1992 Tan et al. ..... 439/141

FOREIGN PATENT DOCUMENTS

| | | |
|---|---|---|
| JP | 6-50270 | 7/1994 |
| JP | 6-54260 | 7/1994 |
| JP | 2601800 | 10/1999 |

* cited by examiner

*Primary Examiner*—Phuong Dinh
(74) *Attorney, Agent, or Firm*—Bacon & Thomas, PLLC

(57) ABSTRACT

The invention provides a jack type connector B with a thin shutter which is to be used in, for example, an IO port of a mobile terminal device such as a portable telephone, and also a plug type connector A which is to be used in combination with the jack type connector with a shutter. In the jack type connector B, a shutter which is molded by an electrically conductive resin material is accommodated in a housing in an openable and closable manner, and the shutter is always urged toward the closing position by a spring member. When the shutter is at the closing position, a butting portion of the shutter is in contact with a grounding contact piece incorporated in the housing. A protrusion is disposed on the lower end of the shutter, whereby a sufficiently large insulation space is ensured between the shutter and terminals. The plug type connector A has terminals and protrusion portions which are projected in front of the terminals. The protrusion portions are useful for pushing open the shutter. When the plug type connector A is pried and tilted, the protrusion portions escape to the outside without changing the initial shape of the jack type connector B.

15 Claims, 19 Drawing Sheets

(A)

(B)

JACK TYPE CONNECTOR WITH A SHUTTER, AND PLUG TYPE CONNECTOR

BACKGROUND OF THE INVENTION

1. Field of the Invention

The present invention relates to a jack type connector with a shutter, and more particularly to a jack type connector with a thin shutter which is to be used in, for example, an IO port of a mobile terminal device such as a portable telephone. In the jack type connector with a shutter of the invention, countermeasures for dustproofing during a non-use period, and for preventing electrostatic discharge damage of electronic devices connected to internal terminals from occurring are taken, and also a countermeasure for enhancing electrical insulation among the internal terminals is taken. In the jack type connector with a shutter of the invention and a plug type connector which uses the jack type connector as a counter connector, a countermeasure for preventing the plug type connector from slipping from the jack type connector and damaging the connectors is taken.

2. Description of the Prior Art

Japanese Utility Model Application Laying-Open No. 6-50270 (first prior art example) discloses a small connector that is a jack type connector in which a countermeasure for dustproofing is taken. The connector has a housing which accommodates terminals overlaid on an inner wall face, and a slider which is disposed in the housing so as to be slidable between a closing position where the slider closes a plug fitting hole of the housing, and an opening position which is in the rear of the closing position. The slider is always elastically urged toward the closing position. When a plug type connector is inserted into the fitting hole, the slider is pushed by the slider from the closing position to the opening position against the elastic urging force. The slider has slide terminals which, in the closing position, are in contact with the terminals, and which, in the opening position, separate from the terminals. When the slide terminals separate from the housing terminals, it is possible to detect that the counter connector is inserted into the fitting hole. In the first prior art example, a contact is provided in a protrusion portion which is to be inserted into the jack type connector, and the protrusion portion pushes the slide of the jack type connector to cause the contact to be in contact with a contact of the counter connector.

Japanese Utility Model Registration No. 2601800 (second prior art example) discloses a jack type connector. In the connector, a housing which accommodates terminals is surrounded by a shield frame, and a cover for opening and closing a plug insertion hole of the housing is formed by an electrically conductive member made of a metal material. When a plug type connector is inserted into the connector, the cover is pushed open by the plug type connector, so that a contact portion which is integrated with the cover is in contact with the shield frame.

Japanese Utility Model Application Laying-Open No. 6-54260 (third prior art example) discloses a jack type connector in which a housing which accommodates terminals is surrounded by a shield frame, and a shutter for closing a plug insertion hole of the housing is formed by an electrically conductive member made of a metal material. The shutter is always connected to the shield frame irrespective of the state of the shutter, or both in the opening and closing states.

In all of the first to third prior art examples, when the plug type connector is not inserted, the internal space of the housing is closed by the slider, the cover, or the shutter so as to perform dust control.

In the first prior art example, the slider is moved forward or backward in the housing to open or close the housing. Therefore, it is required only to ensure a space for accommodating the slider in the opening state, in a rear portion of the housing, and it is not required to ensure a space for accommodating the slider in the opening state, in an upper or lower side of the housing, thereby producing an advantage that the housing can be easily thinned.

In the first prior art example, a molded product of a synthetic resin is used as the slider, and the slider itself does not have a property of shielding the terminals accommodated in the housing from electromagnetic waves. In the case where the housing is incorporated into, for example, a mobile terminal device and the terminals accommodated in the housing are electrically connected to electronic devices of the mobile terminal device, even when the fitting hole of the housing is closed by the slider during a non-use period in which the plug type connector is not inserted into the housing, therefore, external electromagnetic waves are not blocked by the slider and influence the terminals and in turn the electronic devices. As a result, there arises the possibility that electrostatic discharge damage occurs in the electronic devices.

By contrast, in the second and third prior art examples, when the plug type connector is inserted, the cover or the shutter (hereinafter, such a component is referred to as "shutter or the like") is pushed by the counter connector to swing in the opening direction about a horizontal shaft, and accommodated so as to be overlaid on the upper or lower wall of the housing, with the result that the shutter is sandwiched between the plug type connector and the upper or lower wall of the housing. Therefore, a space for accommodating the shutter or the like in the opening state must be ensured in an upper or lower side of the housing. This impedes the thinning of the housing.

In the second and third prior art examples, the shutter or the like is formed by an electrically conductive metal member, and, at least in the closing state, the shutter or the like is electrically connected to the shield frame surrounding the housing. During a non-use period in which the internal space of the housing is closed by the shutter or the like, therefore, the shutter or the like exerts the function of blocking external electromagnetic waves, thereby producing an advantage that the terminals housed in the housing, and the electronic devices which are electrically connected to the terminals are prevented from suffering electrostatic discharge damage.

When the shutter or the like is formed by a metal member, elements such as a boss and a rib which are required for the opening and closing swing operations must be press-formed in the shutter or the like, thereby causing the shutter or the like to have a complex curved shape. Moreover, other elements such as a spring receiving piece for fixing a spring member must be formed by a cutting and raising operation. This causes a problem in that the design of the front face of the shutter is impaired by the bent portion and a hole remaining after the cutting and raising operation. Furthermore, the cut surface must be processed in order to enhance the slidability. Consequently, there arises another problem in that the production cost is correspondingly increased.

In order to solve the problems, it may be contemplated to divide the shutter or the like into a portion having conductivity which is required for providing the function of blocking electromagnetic waves, and mechanical portions such as a boss, form the conductive portion by a metal member, and insert-mold the metal member together with a synthetic resin portion for forming the mechanical portions. However, this causes a further problem in that the charges for a mold and the molding are raised and hence the production cost is increased as a whole.

In a multipolar connector which constitutes an 10 port of a mobile terminal device such as a portable telephone, conventionally, a countermeasure for dustproofing is taken by enabling a cover formed by a molded product of a synthetic resin such as elastomer which is a dielectric, to be attached and detached. However, no countermeasure for preventing electrostatic discharge damage when such a multipolar connector is not used is particularly taken.

In all of the plug type connectors disclosed in the first to third prior art examples, only a small gap is ensured between the protrusion portion which is inserted into the jack type connector, and the inner face of the jack type connector which is positioned on both sides to sandwich the protrusion portion. When the connectors are pried under a state where the protrusion portion is inserted into the jack type connector, therefore, there is the possibility that the protrusion portion strikes against the inner face of the jack type connector, and the portion is damaged or the housing or the like of the counter connector is broken.

SUMMARY OF THE INVENTION

The invention has been conducted in view of the above-discussed situation.

It is an object of the invention to provide a jack type connector with a shutter in which the function of dustproofing during a non-use period is effectively performed by a shutter, and, during a non-use period, the shutter itself remarkably performs the function of blocking external electromagnetic waves to prevent electrostatic discharge damage of internal terminals accommodated in a housing, and electronic devices which are in a mobile terminal device or the like, and which are electrically connected to the internal terminals, from occurring.

It is another object of the invention to provide a jack type connector with a shutter in which the production cost of a shutter can be reduced so as to enable the whole cost to be reduced, and letters or symbols can be easily displayed on the shutter so that the design of the entire connector can be easily enhanced.

It is a further object of the invention to provide a jack type connector with a shutter in which, although a shutter itself is provided with electrical conductivity, electrical insulation among many internal terminals that are densely accommodated in a housing can be easily enhanced.

It is a further object of the invention to provide a plug type connector which, even when the plug type connector that is fittingly coupled to a jack type connector is pried, does not damage a portion inserted into the jack type connector, and the jack type connector.

It is a still further object of the invention to provide a plug type connector which, when the plug type connector that is fittingly coupled to a jack type connector is pried, separates from the jack type connector to prevent the connectors from being damaged.

BRIEF DESCRIPTION OF THE DRAWINGS

FIG. 5 is a schematic horizontal section view showing main portions in an enlarged manner to illustrate an arrangement pattern of internal terminals, and the like;

DETAILED DESCRIPTION OF THE PREFERRED EMBODIMENT

Figure 1:
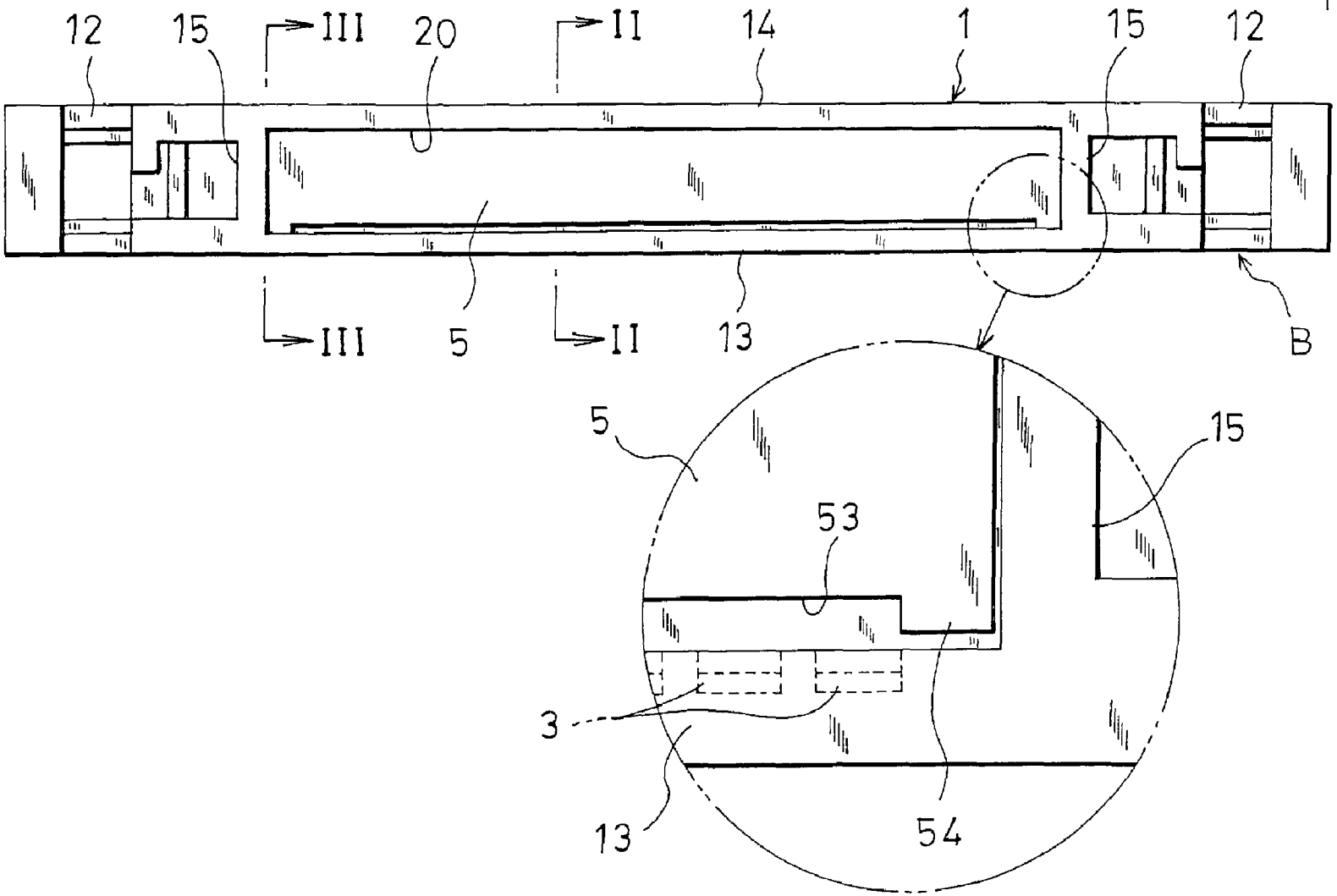
FIG. 1 is a front view showing an embodiment of a multipolar connector with a shutter according to the invention.

Referring to FIGS. 1 to 8, the jack type connector with a shutter of the invention will be described. In the following description, the reference numerals shown in the figures are used in order to facilitate the understanding of the invention. The use of the reference numerals is not intended as restricting the invention to the illustrated example.

The jack type connector B with a shutter of the invention comprises: a housing 1 which has an insertion/extraction port 20 for a plug type connector A serving as a counter connector, and which accommodates a large number of internal terminals 3 that are to be in contact with terminals of the plug type connector A inserted into the insertion/extraction port 20; and a shutter 5 which is closed and opened in an internal space of the housing 1 and between a closing position where the shutter closes the insertion/ extraction port 20, and an opening position where the shutter opens the insertion/extraction port 20.

According to the configuration, since the shutter 5 is closed and opened in the internal space of the housing 1 and between the closing and opening positions, the shutter 5 does not protrude to the outside of the housing 1, and hence it is not required to ensure, as an installation space for the connector, a space which is larger than the size of the housing 1. Therefore, the jack type connector with a shutter is useful as a connector which is to be incorporated into a mobile terminal device such as a portable telephone.

The jack type connector with a shutter of the invention has: the shutter 5 which is electrically conductive; means (a spring member 55) for always elastically urging the shutter 5 toward the closing position; and a grounding contact piece 41 which is disposed in the housing so that, when the shutter 5 is at the closing position, a butting portion 52*a* constituting a part of the shutter 5 is in contact with the grounding contact piece, and, when the shutter 5 is opened from the closing position toward the opening position, the butting portion 52*a* separates from the grounding contact piece. The grounding contact piece 41 may be accommodated in the housing 1. Alternatively, the grounding contact piece 41 may be formed by a shield case 45 which is placed outside the housing 1 to cover the housing 1. In the alternative, preferably, the shutter is formed by a shutter body which is configured by a resin molded product, and a metal sheet which is attached to a front face of the shutter body, and the butting portion is provided in the metal sheet.

According to the configuration described, during a non-use period in which the plug type connector is not inserted into the housing 1, the shutter 5 is at the closing position to close the insertion/extraction port 20, and hence dust does not enter through the insertion/extraction port 20 into the housing 1, whereby the internal terminals 3 and the grounding contact piece 41 which are accommodated in the housing 1 are prevented from being contaminated with dust. As a result, the contact stability of the terminals of the plug type connector A, and the butting portion 52*a* with respect to the internal terminals and the grounding contact piece is improved. Since the shutter 5 is electrically conductive and, when the shutter 5 is at the closing position, the butting portion 52*a* constituting a part of the shutter 5 is in contact with the grounding contact piece 41, the shutter 5 itself exhibits the electromagnetic wave shielding performance to block external electromagnetic waves. Therefore, the internal terminals 3 which are accommodated in the housing 1, electronic devices which are electrically connected to the internal terminals 3, and the like are prevented from suffering electrostatic discharge damage.

In the invention, preferably, the shutter 5 is integrally molded by an electrically conductive resin material. According to the configuration, the shutter 5 can be integrally molded easily and economically, and letters and/or symbols can be engraved on a molding die so that they can be three-dimensionally indicated on the surface of the shutter 5. When the conductive resin material is appropriately toned, the shutter 5 can be colored without conducting a coating operation. Therefore, the design and color of the shutter 5 can be easily matched for the appearance of a mobile terminal device into which the jack type connector is to be incorporated.

In the invention, preferably, the housing 1 is configured in the following manner. The housing 1 has a box-like hollow shape which is elongated laterally. A large number of recesses 21 are laterally arranged in plural places of a bottom wall 13 of the housing 1. Each of the recesses is surrounded by a front ridge 22 which is disposed in a front edge of the bottom wall 13, and which are elongated laterally, and right and left side ridges 23 which elongate from the front ridge 22 toward a rear side of the bottom wall 13. The internal terminals 3 are accommodated in the recesses 21, respectively. Upper end faces of the front ridge 22 and the side ridges 23 are at a higher level than the upper faces of the internal terminals 3.

According to the configuration described, even when a lower end edge 53 of the shutter 5 is in sliding contact with the upper end faces of the front ridge 22 and the side ridges 23, a gap is ensured between the shutter 5 and the upper faces of the internal terminals 3, so that there never occurs a situation in which the conductive shutter 5 is in contact with the internal terminals 3 to short-circuit the internal terminals 3. Even when the jack type connector is formed into a very thin shape, therefore, it is possible to prevent an erroneous signal due to a contact between the conductive shutter 5 with the internal terminals 3 from being generated, and hence performance stability is improved.

In the invention, preferably, a protrusion 54 for ensuring a gap space between a lower end edge of the shutter 5 and the internal terminals 3 projects from the lower end edge of the shutter 5, or the front ridge 22. According to the configuration, a gap space S for enhancing the electrical insulation between the lower end edge of the shutter 5 and the internal terminals 3 is ensured, and the creep age distance between the internal terminals 3 and the shutter 5 is prolonged, so that performance stability is further improved. The protrusion 54 may project from only the lower end edge of the shutter 5, only the front ridge, or both the lower end edge of the shutter and the front ridge.

The invention may be configured in the following manner. A plate-like conductor 4 is accommodated in a recess 19 which is formed in a wall face of a lateral end portion of the housing 1. The grounding contact piece 41 which projects upward in the recess 19 is formed integrally with a front end portion of the conductor 4. An engagement claw 51 is disposed on a lateral end portion of the shutter 5. When the shutter 5 is at the closing position, the engagement claw is engaged with a rear end face 41*a* of the grounding contact piece 41. When the shutter 5 is opened from the closing position toward the opening position, the engagement claw separates from the rear end face 41*a* of the grounding contact piece 41. An engagement/disengagement portion of the engagement claw 51 with respect to the rear end face 41*a* of the grounding contact piece 41 is formed as the butting portion 52*a*. According to the configuration, the engagement between the engagement claw 51 and the rear end face 41*a* of the grounding contact piece 41 can prevent a situation in which the shutter 5 slips from the housing 1, from occurring. Therefore, it is not required to additionally dispose means for preventing the shutter 5 from slipping off, and hence the structure is correspondingly simplified. Since the butting portion 52*a* is formed on the engagement claw 51 which performs the slipping-off preventing function, it is not required to additionally dispose the butting portion 52*a*, whereby the structure is further simplified.

In the invention, it is possible to employ a configuration in which the shutter 5 is longitudinally movably accommodated in the housing 1, directions of opening and closing the shutter 5 coincide respectively with longitudinal directions of the housing 1, and a spring member 55 which always elastically urges the shutter 5 toward the closing position is interposed between the shutter 5 and a rear end wall 16 of the housing 1. According to the configuration, in the same manner as the first prior art example which has been described in the opening paragraph of the specification, the shutter 5 is simply longitudinally moved in the housing 1 so as to be opened or closed, and hence the space for accommodating the shutter in the opening state is required only to be ensured in the rear portion of the housing 1. Since it is not required to ensure a space for accommodating the shutter in the opening state in the upper or lower side of the housing 1, the housing 1 can be easily thinned.

As described above, according to the jack type connector with a shutter of the invention, the function of dustproofing during a non-use period is effectively performed by the shutter, and, during a non-use period, the shutter itself remarkably performs the function of blocking external electromagnetic waves to prevent electrostatic discharge damage of internal terminals accommodated in the housing, and electronic devices which are in a mobile terminal device or the like, and which are electrically connected to the internal terminals, from occurring. Moreover, the shutter can be economically produced by a molding process using an electrically conductive resin material, and hence the production cost of the jack type connector can be easily reduced. Letters and/or symbols can be easily indicated on the shutter, so that the design of the connector can be easily enhanced. Although the shutter itself is provided with electrical conductivity, an effect that electrical insulation among the many internal terminals that are densely accommodated in the housing can be easily enhanced is attained.

Next, the plug type connector A of the present invention will be described with reference to FIGS. 11 to 20. In this description, the reference numerals shown in the figures are used in order to facilitate the understanding of the invention. The use of the reference numerals is not intended as restricting the invention to the illustrated example.

In the plug type connector A of the invention, the above-described jack type connector B which is elongated laterally is used as the counter connector.

The plug type connector A of the invention has: terminals 73 which are to be inserted into an internal space S1 of the jack type connector B that is elongated laterally and serves as a counter connector, through the insertion/extraction port 20 that is elongated laterally and has a rectangular shape, whereby the terminals are caused to be respectively in contact with the internal terminals 3 of the jack type connector B; a butting portion 63*a* which butts against a receiving portion 24*a* of the jack type connector B to restrict a degree of insertion of the terminals 73 with respect to the internal space S1; and protrusion portions 8 which project in front of the terminals 73, and which, when the terminals 73 are inserted into the internal space S1 of the jack type connector B through the insertion/extraction port 20, pushes open the shutter 5 which closes the insertion/extraction port 20 of the jack type connector B.

In the invention, the protrusion portions 8 have a shape which, in accordance with a tilting motion of the plug type connector A caused by prying the plug type connector in a thickness direction, allows the protrusion portions 8 to escape to an outside of the internal space S1 through the insertion/extraction port 20 without changing an initial shape of peripheral wall faces of the internal space S1, and an initial shape of the shutter 5 which is opened by the protrusion portions 8, and the internal terminals 3 of the jack type connector B are placed outside loci of movement in which the protrusion portions 8 escape to the outside of the internal space S1 through the insertion/extraction port 20.

According to the configuration described, even when the plug type connector A is pried and tilted in the thickness direction T, the protrusion portions 8 inserted into the jack type connector B can escape therefrom without damaging the jack type connector B and the shutter 5, and there is no possibility that the internal terminals 3 of the jack type connector B are damaged. Moreover, there is no possibility that the internal terminals 3 are damaged.

In the invention, the insertion/extraction port 20 of the jack type connector B is opened in a front end of the housing 1 of the jack type connector B, the receiving portion 24*a* is formed by a front end face of the housing 1, the front end face forming an edge portion of the insertion/extraction port 20, the butting portion 63*a* is formed by a front end face of the plug type connector A, and, when the plug type connector A is pried in the thickness direction T under a state where the butting portion 63*a* butts against the receiving portion 24*a*, the plug type connector A is tilted by using one place of the butting areas between the butting portion 63*a* and the receiving portion 24*a* as a fulcrum P1 or P2, the one place being in the thickness direction T of the plug type connector A.

It is possible to employ a configuration in which a shape of the protrusion portions 8 which are inserted into the internal space S1 of the jack type connector B to push open the shutter 5 is determined so that the protrusion portions are positioned inside a virtual circle R1 or R2 which is centered at the fulcrum P1 or P2, and which has a radius elongating from a position of the fulcrum to the edge of the insertion/extraction port 20, the edge being in a remoter side from the position of the fulcrum.

In this case, a position of each of the outer edges on both sides in a thickness direction of the front end face of the jack type connector B which butts against a rectangular and laterally elongating front end face 63 of a housing 6 of the plug type connector A is assumed as the position of the fulcrum of the prying and tilting of the plug type connector A. A shape of the protrusion portions 8 is determined so that the protrusion portions are positioned inside the virtual circle R1 which is centered at the one fulcrum P1 that is assumed by the position of the one of the outer edges on both sides in the thickness direction, which has the radius elongating to the edge of the insertion/extraction port 20, the edge being in a remoter side from the position of the one fulcrum, and inside the virtual circle R2 which is centered at the other fulcrum P2 that is assumed by the position of the other outer edge, and which has a radius elongating to the edge of the insertion/extraction port 20, the edge being in a remoter side from the position of the other fulcrum. Preferably, an outer profile line L of each of the protrusion portions 8 has an ovaloid shape which elongates along the two virtual circles R1 and R2.

In the invention, preferably, contact pieces 7 are incorporated in the housing 6 of the plug type connector A, the terminals 73 which are formed into a protruding arcuate shape are disposed in front ends of the contact pieces 7, respectively, each of the terminals 73 is projected outside the outer profile line L of the corresponding one of the protrusion portions 8, between the front end face 63 of the housing 6 of the plug type connector A, and a front end 81 of the protrusion portion 8, and the internal terminals 3 of the jack type connector B are arranged so as to be overlaid on an inner face of the housing 1 of the jack type connector B in the thickness direction of the jack type connector B.

Preferably, the contact pieces 7 are elastically deformable in the thickness direction of the plug type connector A.

In the invention, the housing 1 of the jack type connector B, and the housing 6 of the plug type connector A are provided with an engagement claw 92 and an engagement face 25, respectively, the engagement claw 92 and the engagement face 25 engaging with each other when the butting portion 63*a* butts against the receiving portion 24*a*, the engagement between the engagement claw 92 and the engagement face 25 being canceled in accordance with separation of the butting portion 63*a* from the receiving portion 24*a*, and, when the plug type connector A is pried and tilted in the thickness direction, a locus of movement of the engagement claw 92 in which the engagement with the engagement face 25 is canceled is inside relief recesses 26 which are formed on both sides of the engagement face 25, respectively.

In this case, the engagement claw 92 is disposed at a tip end of an elastically deformable rod 91 which is disposed on the housing 6 of the plug type connector A, and the engagement claw 92 comprises an inclined guide face 94 which slides over an edge of one of the relief recesses 26 to override the edge.

The functions of the jack type connector B with a shutter and the plug type connector A of the invention will be more apparent from embodiments in the following description.

Figure 2:
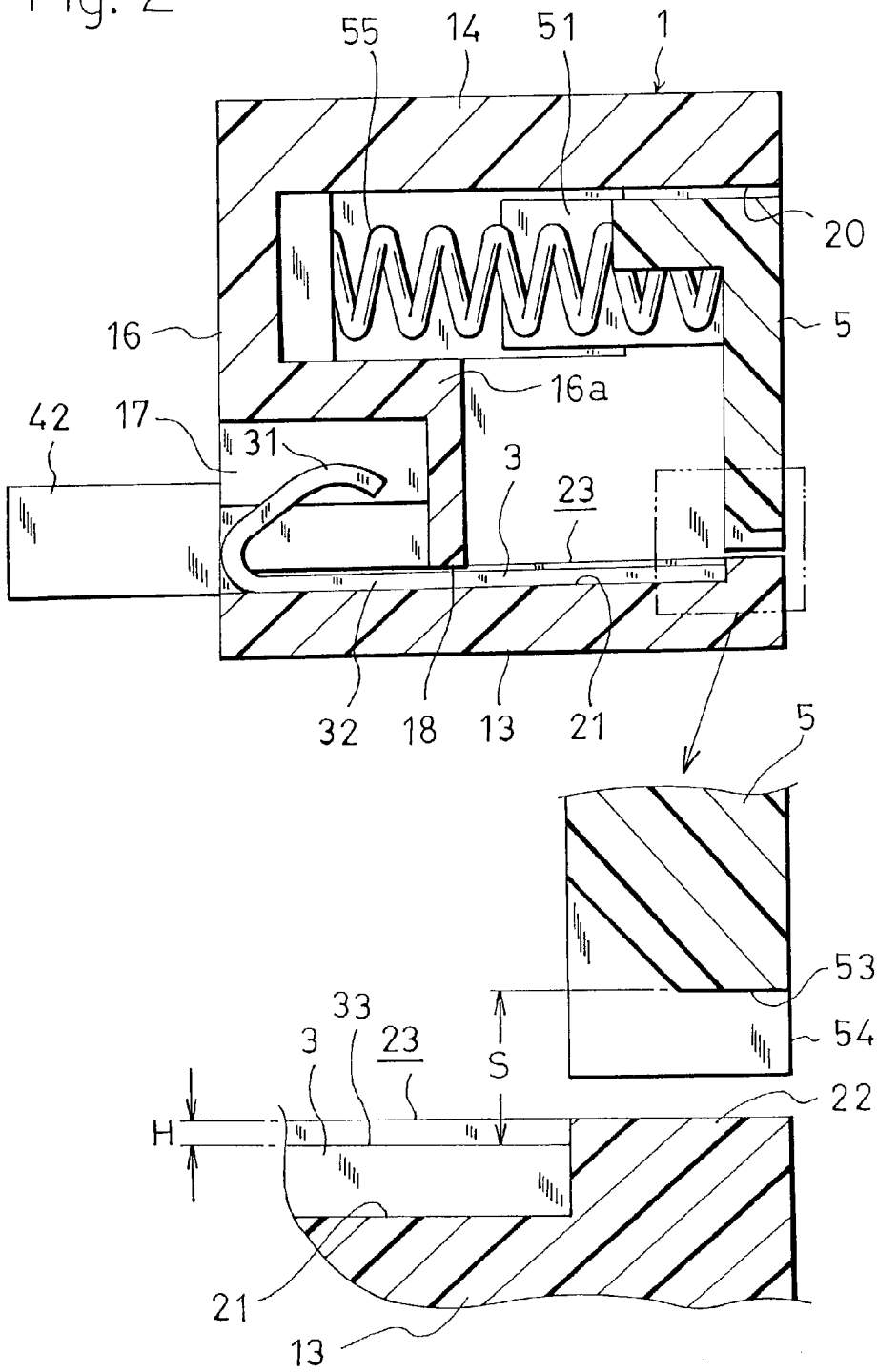
FIG. 2 is a schematic vertical section view showing portions along the line II-II of FIG. 1 in an enlarged manner.
Figure 5:
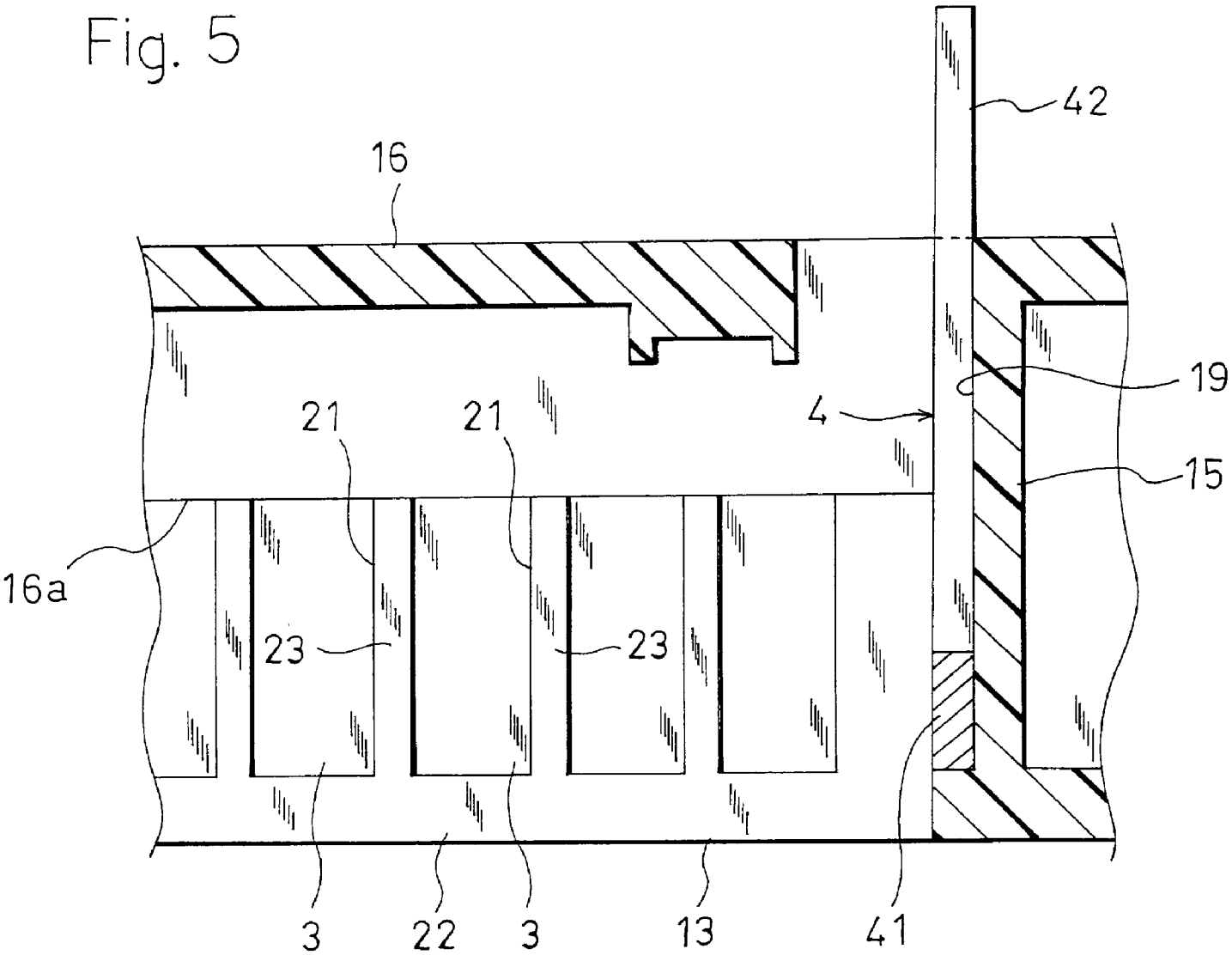

The jack type connector with a shutter is to be incorporated into a portable telephone serving as a mobile terminal device, and used for forming an IO port. In the connector, a flat hollow housing 1 which laterally elongates comprises integrally an engagement portion 12 for preventing a plug type connector A (see FIGS. 6 and 7) serving as counter connector from slipping off, in each of the lateral ends of the housing. The housing 1 is configured by an integral molded product of a synthetic resin having an excellent electrical insulation property. The housing has: a bottom wall 13; an upper wall 14 which is opposed to the bottom wall 13; right and left end walls 15 which couple the bottom wall 13 and the upper wall 14 at the right and left ends; and a rear wall 16. A lower portion of the rear wall 16 is recessed to form a recessed portion 16*a* which defines a contact piece accommodating space 17. As shown in FIG. 2 or 5, recesses 21 which are laterally arranged are formed in plural equally-spaced places of the bottom wall 13. Each of the recesses 21 is surrounded to be formed into a rectangular shape, by: a front ridge 22 which is disposed in a front edge of the bottom wall 13, and which laterally elongates; right and left side ridges 23 which elongate from the front ridge 22 toward a rear side of the bottom wall 13; and the recessed portion 16*a* of the rear wall 16. Thin plate-like terminals 3 are accommodated in the recesses 21, respectively. The ridges 22 and 23 have the same height which is slightly larger than the thickness of the terminals 3. Therefore, the upper end faces of the front ridge 22 and the right and left side ridges 23 are located at a position which is higher in level by a dimension H than the upper faces of the terminals 3 that are overlaid on the bottom faces of the recesses 21 (see FIG. 2).

Figure 6:
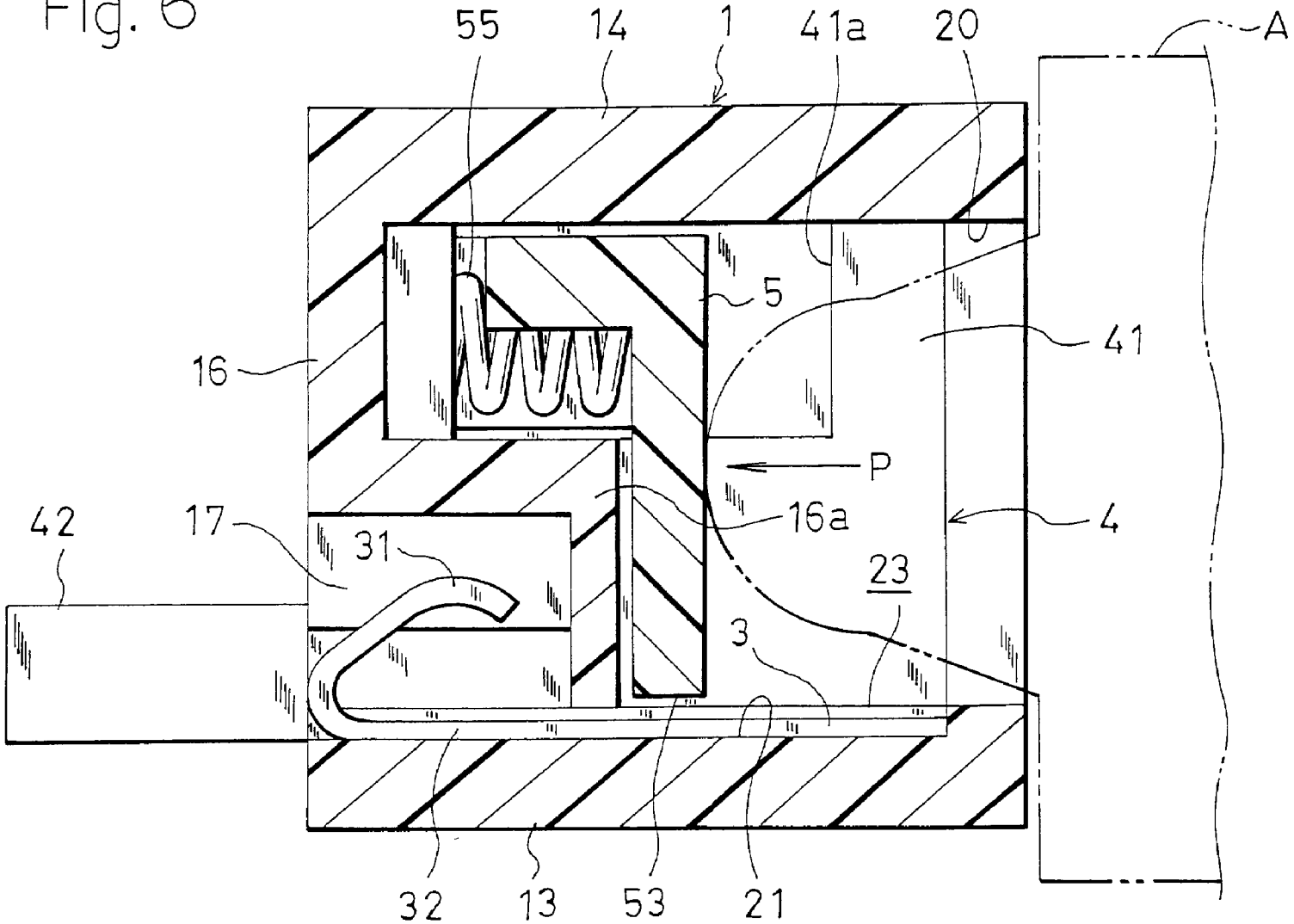
FIG. 6 is a schematic vertical section view showing a state in which a plug type connector is inserted, and corresponding to FIG. 2.

As shown in FIGS. 2 and 6, an extension 32 having a folded contact piece 31 is continuously integrated with each of the terminals 3 so as to be elongated rearward. The extension 32 elongates into the contact piece accommodating space 17 through a hole 18 formed in the rear wall 16, and the contact piece 31 is accommodated in the contact piece accommodating space 17. The terminals 3 each integrated with the contact piece 31 are placed in the recess 21 through the hole 18 from the back (rear) of the housing 1.

Figure 3:
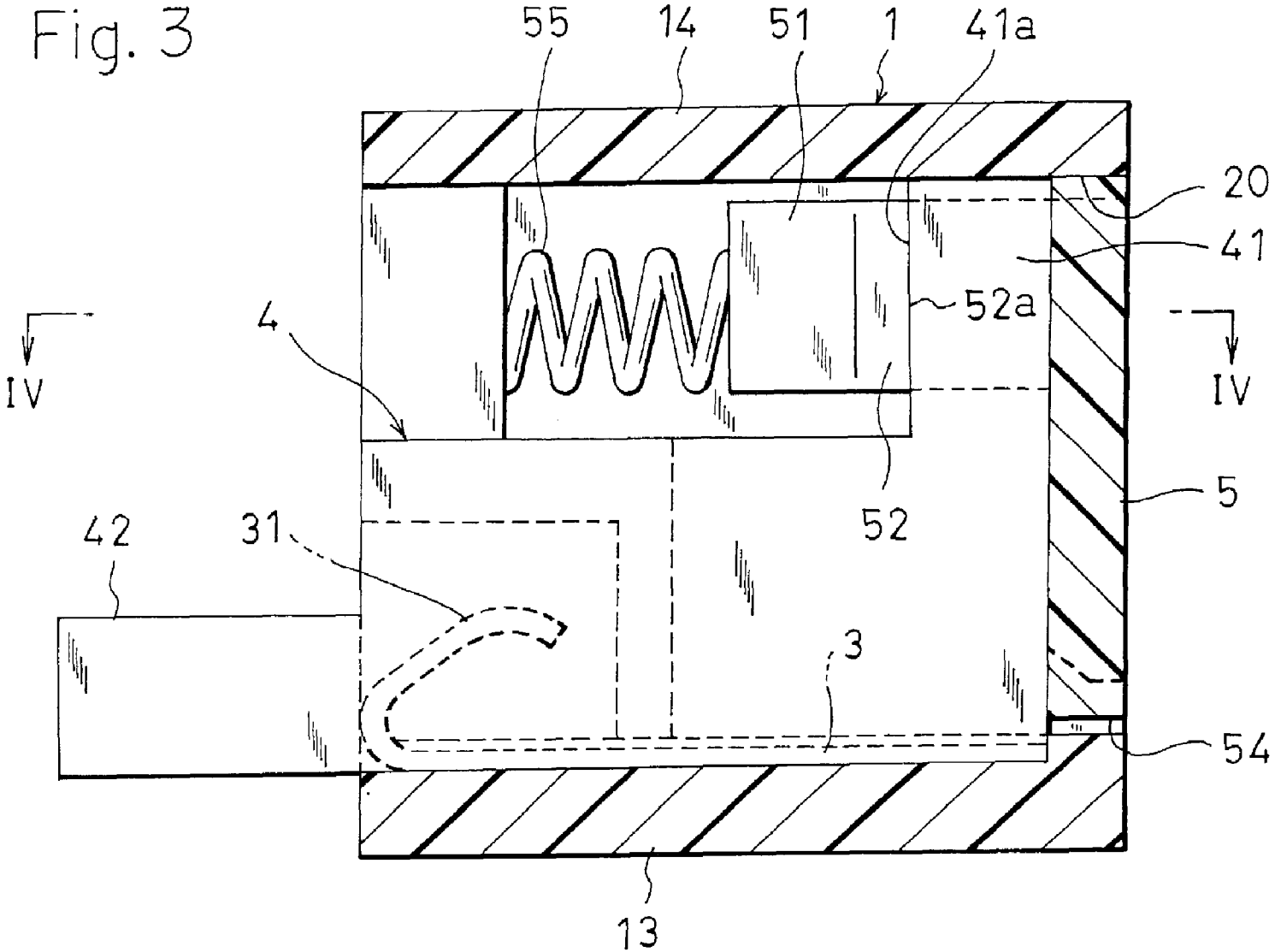
FIG. 3 is a schematic vertical section view showing portions along the line III-III of FIG. 1 in an enlarged manner.
Figure 4:
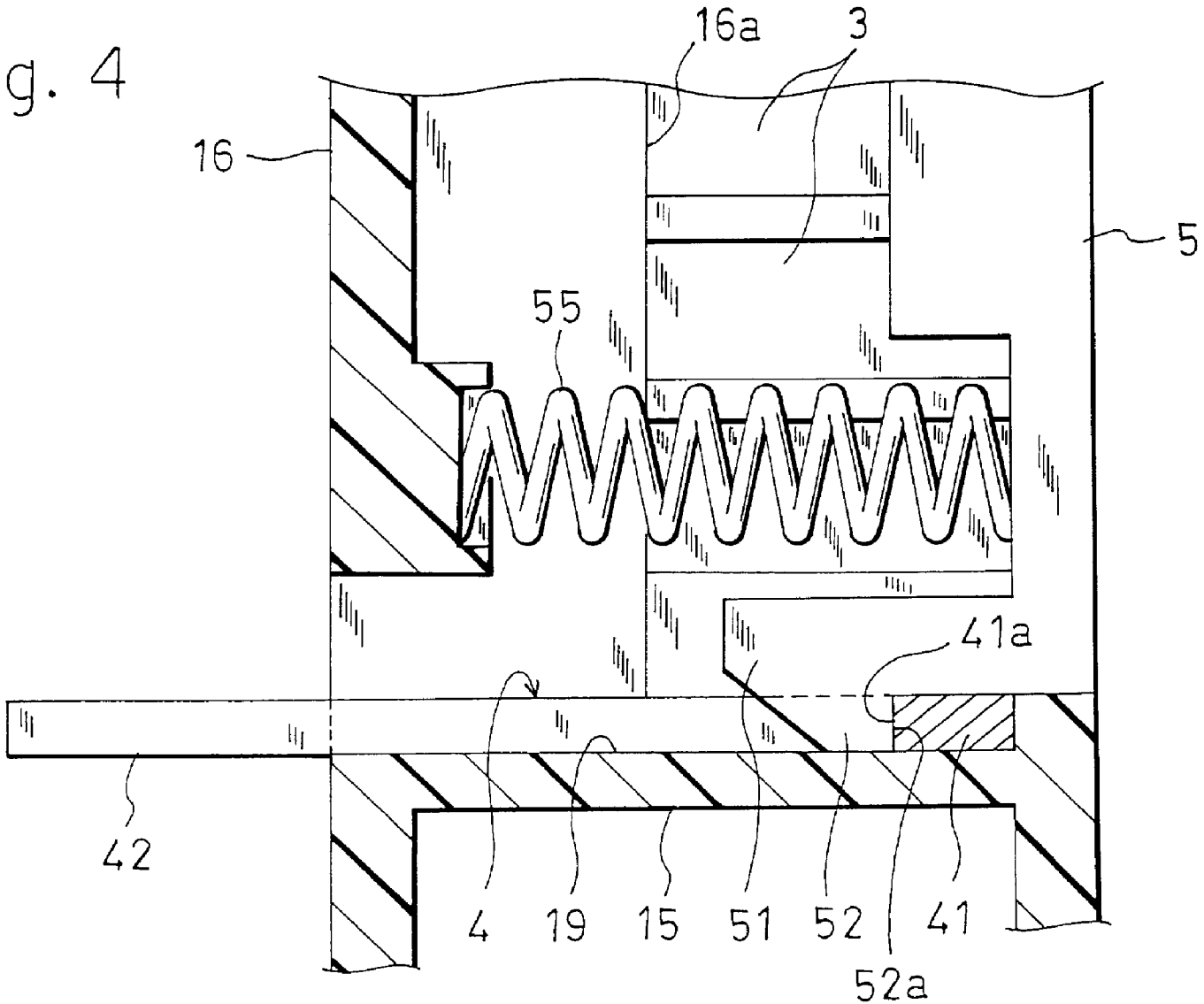
FIG. 4 is a schematic horizontal section view showing portions along the line IV-IV of FIG. 3.
Figure 7:
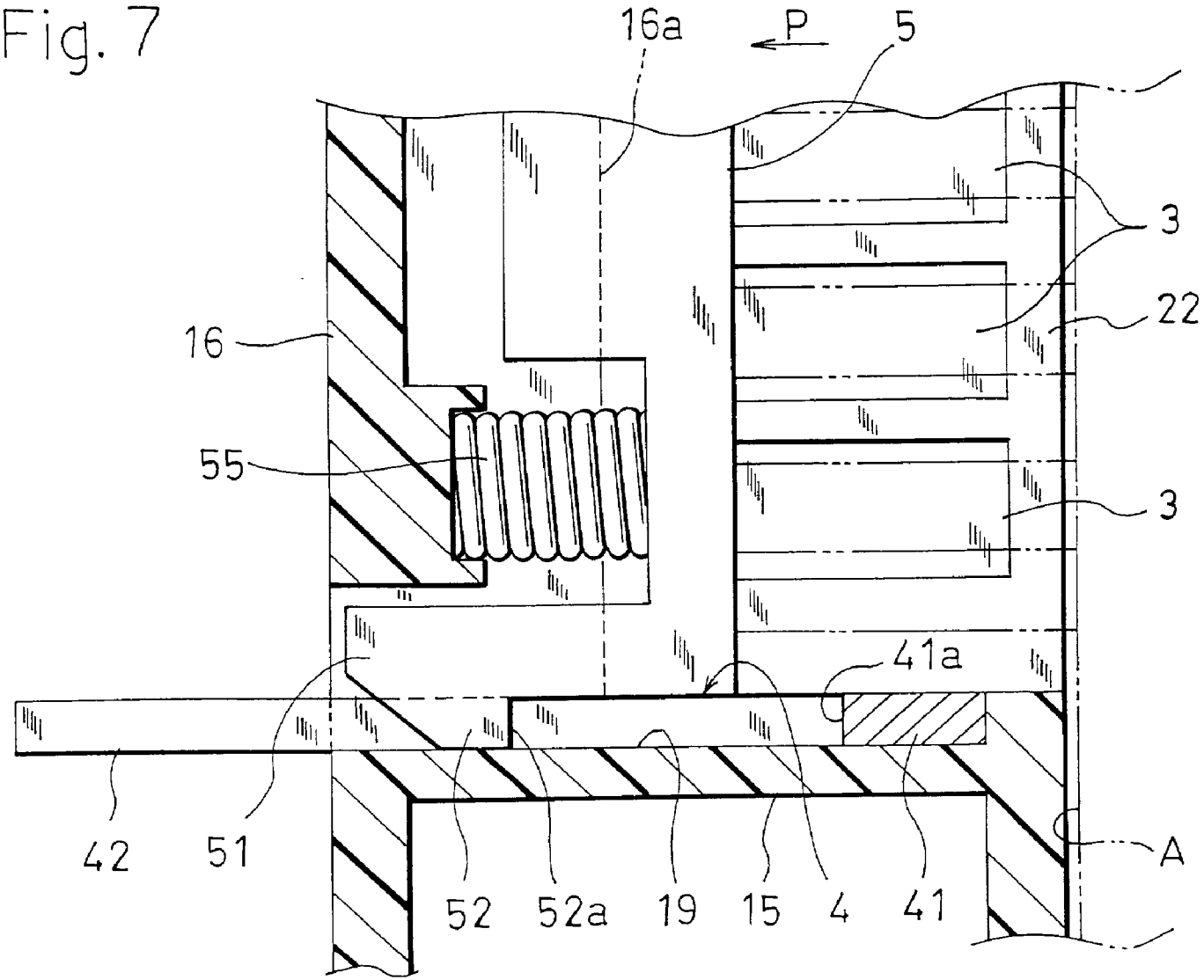
FIG. 7 is a schematic horizontal section view showing a state in which the plug type connector is inserted, and corresponding to FIG. 4.

As shown in FIG. 4, 5, or 7, in an inner face of each of the right and left (lateral) end walls 15 of the housing 1, a recess 19 is formed so as to extend from the rear end of the end wall 15 to a position in the vicinity of the front end. A plate-like conductor 4 is fitted into the recess 19. As shown in FIG. 3, the conductor 4 has a grounding contact piece 41 which upward protrudes from the front end portion of the conductor into the recess 19, and a connecting terminal 42 in a rear end portion. The connecting terminal 42 can be connected to a grounding circuit which is not shown.

An insertion/extraction port 20 through which the plug type connector A is to be inserted and extracted is formed in the front end of the housing 1. The housing 1 comprises a shutter 5 which is longitudinally slid to be closed and opened in the internal space of the housing and between the closing position where the shutter closes the insertion/extraction port 20, and the opening position where the shutter opens the insertion/extraction port 20. When the shutter 5 is configured so as to be closed and opened by longitudinal sliding operations, it is required only to ensure a space for accommodating the shutter in the opening state, in a rear portion of the housing 1, and it is not required to ensure a space for accommodating the shutter in the opening state, in an upper or lower side of the housing 1. Therefore, the housing can be easily thinned.

The shutter 5 is integrally molded by an electrically conductive resin material. Engagement claws 51 project rearward from right and left (lateral) end portions of the shutter, respectively. As shown in FIG. 4 or 7, each of the engagement claws 51 is provided with a claw piece 52 which projects laterally outward. The claw piece 52 is accommodated in the recess 19 above the conductor 4 so as to be opposed to a rear end face 41*a* of the grounding contact piece 41. When the shutter 5 is at the closing position, the front end face of the claw piece 52 is engaged with the rear end face 41*a* of the grounding contact piece 41 as shown in FIG. 3 or 4, thereby preventing the shutter 5 from slipping from the housing 1. Under the state where the front end face of the claw piece 52 is engaged with the rear end face 41*a* of the grounding contact piece 41, the grounding contact piece 41 is in contact with the shutter 5 to be electrically connected therewith. By contrast, when the shutter 5 is opened from the closing position toward the opening position as shown in FIG. 7, the front end face of the claw piece 52 separates from the rear end face 41*a* of the grounding contact piece 41, thereby canceling the electrical connection state between the grounding contact piece 41 and the shutter 5. Therefore, the front end face of the claw piece 52 corresponds to an engagement/disengagement portion with respect to the rear end face of the grounding contact piece 41, and serves as a butting portion 52*a* with respect to the grounding contact piece 41. A spring member 55 configured by a coil spring is interposed between the shutter 5 and the rear wall 16 of the housing 1. The shutter 5 is always elastically urged toward the closing position by the spring member 55.

As shown in FIG. 2, a protrusion 54 for ensuring a gap space S between the lower end edge 53 of the shutter 5 and the terminals 3 is projected downward from the lower end of a lateral end portion of the shutter 5. When the protrusion 54 is disposed on the lower end of the lateral end portion of the shutter 5 in this way to ensure the gap space S between the lower end edge 53 of the shutter 5 and the terminals 3, the electrical insulation between the lower end edge 53 of the shutter 5 and the terminals 3 is improved, and the creepage distance between the terminals 3 and the shutter 5 is prolonged. Although the shutter 5 is electrically conductive, therefore, there never occurs a situation in which the terminals 3 that are laterally arranged are short-circuited and an erroneous signal is generated.

In the jack type connector B with a shutter of the embodiment, during the non-use period in which the counter plug type connector A is not inserted, the shutter 5 which is elastically urged by the spring member 55 as shown in FIGS.

2 to 4 is at the closing position to close the insertion/extraction port 20. Therefore, dust does not enter through the insertion/extraction port 20 into the housing 1, so that the terminals 3 and the grounding contact piece 41 which are accommodated in the housing 1 are prevented from being contaminated with dust. Since the butting portion 52*a* of the engagement claw 51 is in contact with the grounding contact piece 41, the shutter 5 itself which has the engagement claw 51 exhibits the electromagnetic wave shielding performance to block external electromagnetic waves. Therefore, the terminals which are accommodated in the housing, electronic devices which are electrically connected to the terminals, and the like are prevented from suffering electrostatic discharge damage. Even when the shutter 5 is in contact with the bottom wall 13 of the housing 1, at least a gap of the dimension H shown in FIG. 2 is ensured between the lower end edge 53 and the protrusion 54 of the shutter 5, and the terminals 3, and hence a situation in which the conductive shutter 5 is in contact with the terminals 3 to short-circuit the terminals 3 does not occur. Even when the multipolar connector is formed into a very thin shape, therefore, it is possible to prevent an erroneous signal due to a contact between the conductive shutter 5 with the terminals 3 from being generated.

When the plug type connector A (phantom line) is inserted into the insertion/extraction port 20 as indicated by the arrow P in FIGS. 6 and 7, the shutter 5 is pushed rearward from the closing position toward the opening position by the plug type connector A against the urging by the spring member 55, and in accordance with this the butting portion 52*a* separates from the grounding contact piece 41. A large number of terminals (not shown) of the plug type connector A are in contact with the terminals 3, respectively.

In the above-described jack type connector B with a shutter, since the shutter 5 is integrally molded by an electrically conductive resin material, letters and/or symbols can be three-dimensionally indicated on the surface of the shutter 5, simply by engraving them on a die for molding the shutter. When the conductive resin material is appropriately toned, the shutter 5 can be colored without conducting a coating operation. Therefore, the design and color of the shutter 5 can be easily matched for the appearance of a mobile terminal device into which the multipolar connector is to be incorporated.

In the embodiment, as shown in FIG. 1, the protrusion 54 for ensuring the gap space S between the lower end edge 53 of the shutter 5 and the terminals 3 project downward from the lower end of a lateral end portion of the shutter 5, thereby enhancing the electrical insulation between the conductive shutter 5 and the terminals. This can be realized also by employing another configuration.

Figure 8:
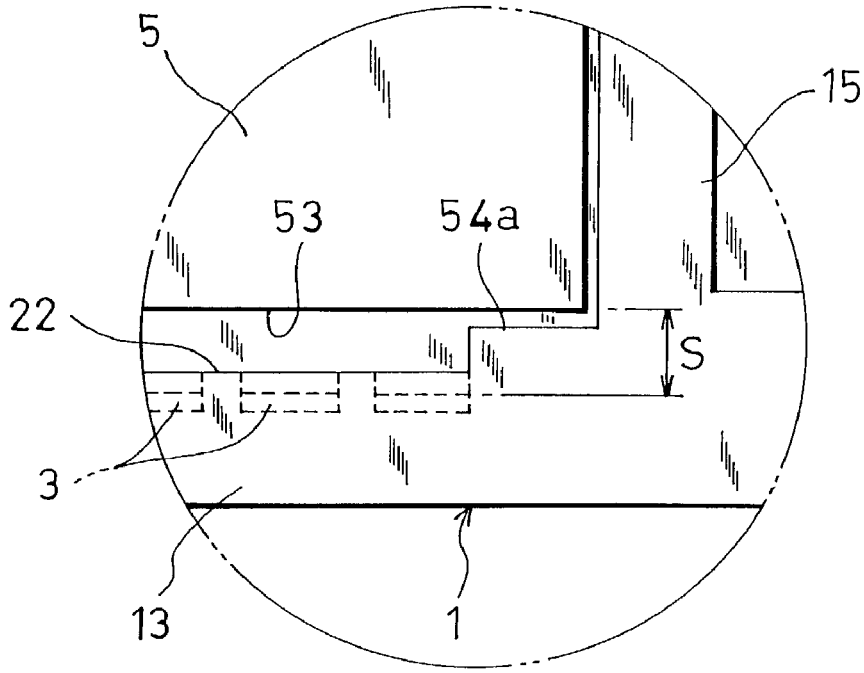
FIG. 8(A) is an enlarged view illustrating a modification of a protrusion.
FIG. 8(B) is an enlarged view illustrating another modification of the protrusion.
Figure 8:
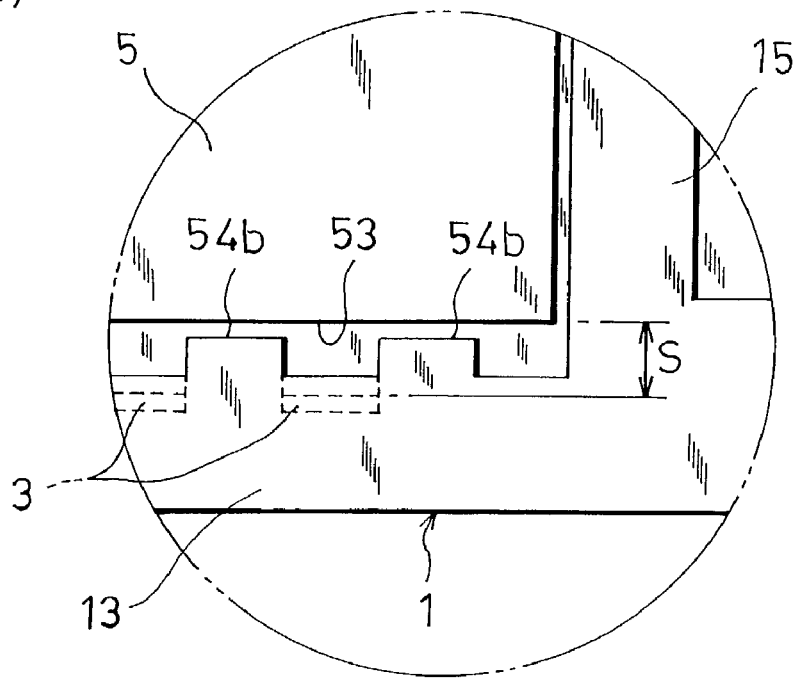

Examples of such a configuration are shown in FIG. 8. FIG. 8 is an. enlarged view illustrating modifications of the provision 54. In the example shown in (A) of the figure, a protrusion 54*a* which is upward projected is formed on a lateral end portion of the front ridge 22 formed on the bottom wall 13 of the housing 1, whereby the gap space S is ensured between the lower end edge 53 of the shutter 5 and the terminals 3 so as to enhance the electrical insulation between the conductive shutter 5 and the terminals. In the example shown in (B) of the figure, protrusions 54*b* which project upward are formed in plural equally-spaced places of the front ridge 22 formed on the bottom wall 13 of the housing 1, whereby the gap space S is ensured between the lower end edge 53 of the shutter 5 and the terminals 3 so as to enhance the electrical insulation between the conductive shutter 5 and the terminals. Although not shown in the figures, a protrusion may be projected from both the lower end edge of the shutter and the front ridge, whereby the gap space S is ensured between the lower end edge 53 of the shutter 5 and the terminals 3 as to enhance the electrical insulation between the conductive shutter 5 and the terminals.

Figure 9:
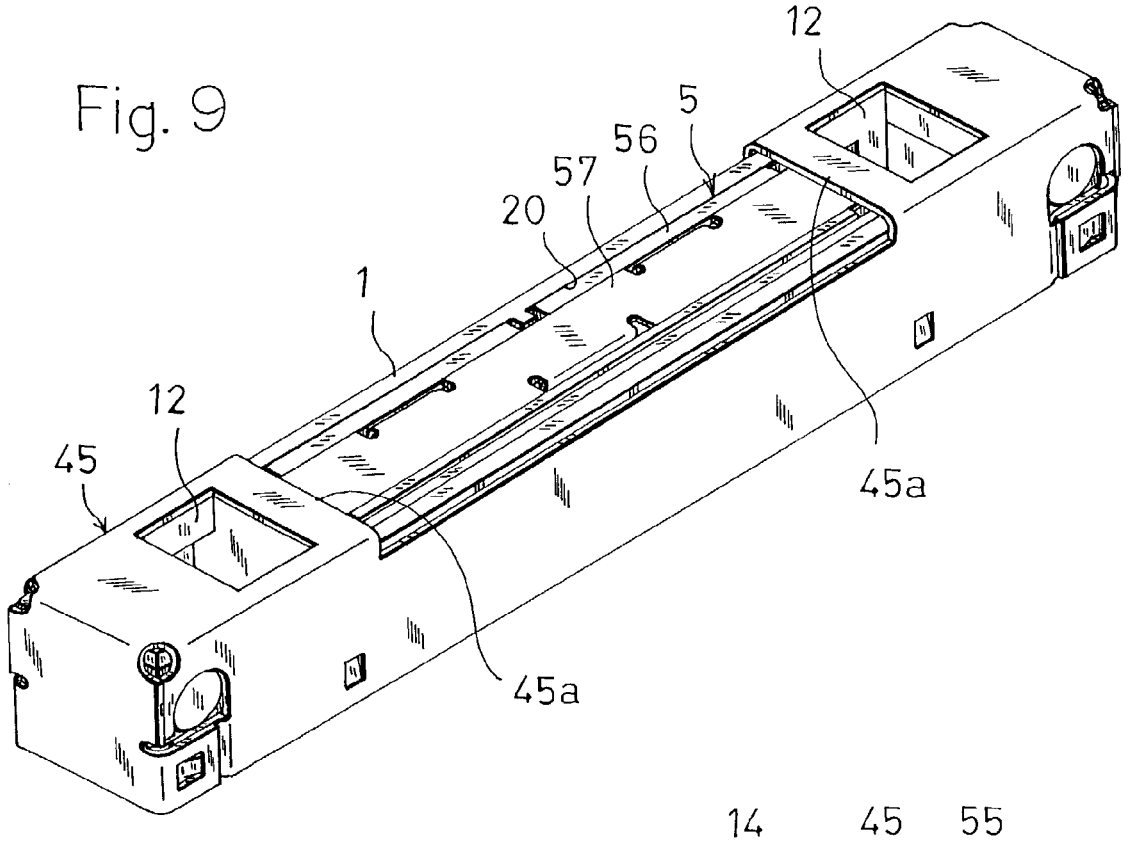
FIG. 9 is a perspective view of a multipolar connector with a shutter which is another embodiment.
Figure 10:
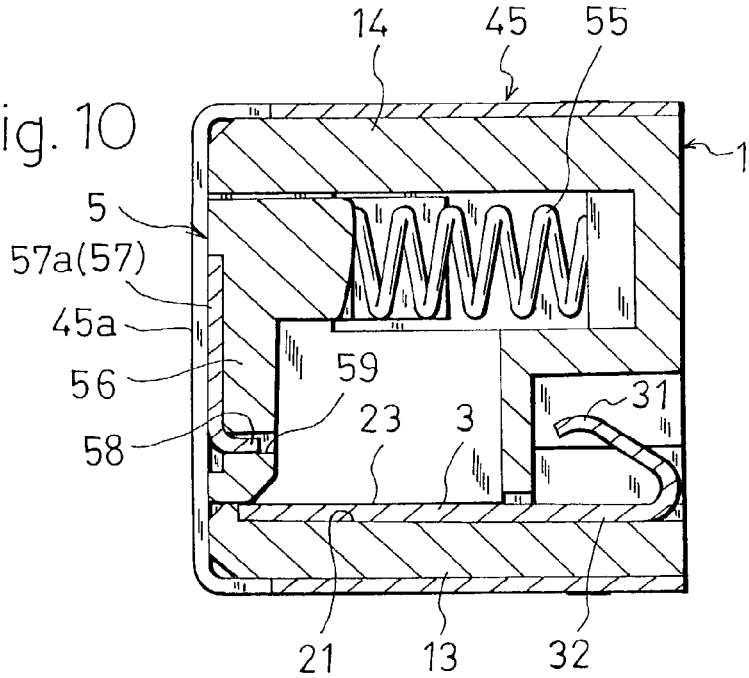
FIG. 10 is a section view of main portions of the multipolar connector with a shutter of FIG. 9.

FIGS. 9 and 10 show another embodiment of the jack type connector with a shutter.

In the jack type connector with a shutter of the embodiment, a shield case 45 which is formed by applying a mechanical process such as a bending process on a metal sheet is placed outside the flat hollow housing 1 which laterally elongates, so that the housing 1 is covered by the shield case 45. More specifically, the shield case 45 is overlaid on the front face of the housing 1, the lower face of the bottom wall 13, and the upper face of the upper wall 14. In the embodiment, the shield case 45 corresponds to the grounding contact piece 41 formed by the conductor 4 in the embodiment which has been described with reference to FIGS. 1 to 8.

By contrast, as shown in FIG. 9, the shutter 5 is formed by the shutter body 56 which is configured by a resin molded product, and a metal sheet 57 which is attached to the front face of the shutter body 56. The metal sheet 57 is disposed over a substantially whole lateral length of the shutter body 56 which is elongated laterally. Lateral end portions of the shutter body 56 are opposed to projection pieces 45*a* of the shield case 45 which are projected from lateral end portions of the insertion/extraction port 20 of the housing 1, respectively. The lateral end portions are formed as butting portions 57*a*. When the shutter 5 is at the closing position, the butting portions 57*a* of the shutter 5 are in contact with the projection pieces 45*a* of the shield case 45, and, when the shutter 5 is at the opening position, the butting portions 57*a* of the shutter 5 separate from the projection pieces 45*a* of the shield case 45. As shown in FIG. 10, an engagement piece 58 which is disposed on the lower end of the metal sheet 57 is engaged with an engagement hole 59 which is formed in the shutter body 56, thereby fixing the metal sheet 57 to the shutter body 56.

The other configuration is similar to that of the embodiment which has been described with reference to FIGS. 1 to 8. In FIGS. 9 and 10, therefore, the components which are identical with those of FIGS. 1 to 8 are denoted by the same reference numerals. The detailed description of their structures is omitted.

In the jack type connector B with a shutter, during the non-use period in which the counter plug type connector is not inserted, the shutter 5 which is elastically urged by the spring member 55 is at the closing position to close the insertion/extraction port 20 of the housing 1. Therefore, dust does not enter through the insertion/extraction port 20 into the housing 1, so that the terminals 3 and the grounding contact piece 41 which are accommodated in the housing 1 are prevented from being contaminated with dust. Since the butting portions 57*a* of the metal sheet 57 of the shutter 5 are in contact with the projection pieces 45*a* of the shield case 45 which serve as grounding contact pieces, the shutter 5 exhibits the electromagnetic wave shielding performance to block external electromagnetic waves. Therefore, the terminals which are accommodated in the housing, electronic devices which are electrically connected to the terminals, and the like are prevented from suffering electrostatic discharge damage.

FIGS. 11 to 20 show an embodiment of the plug type connector.

Figure 11:
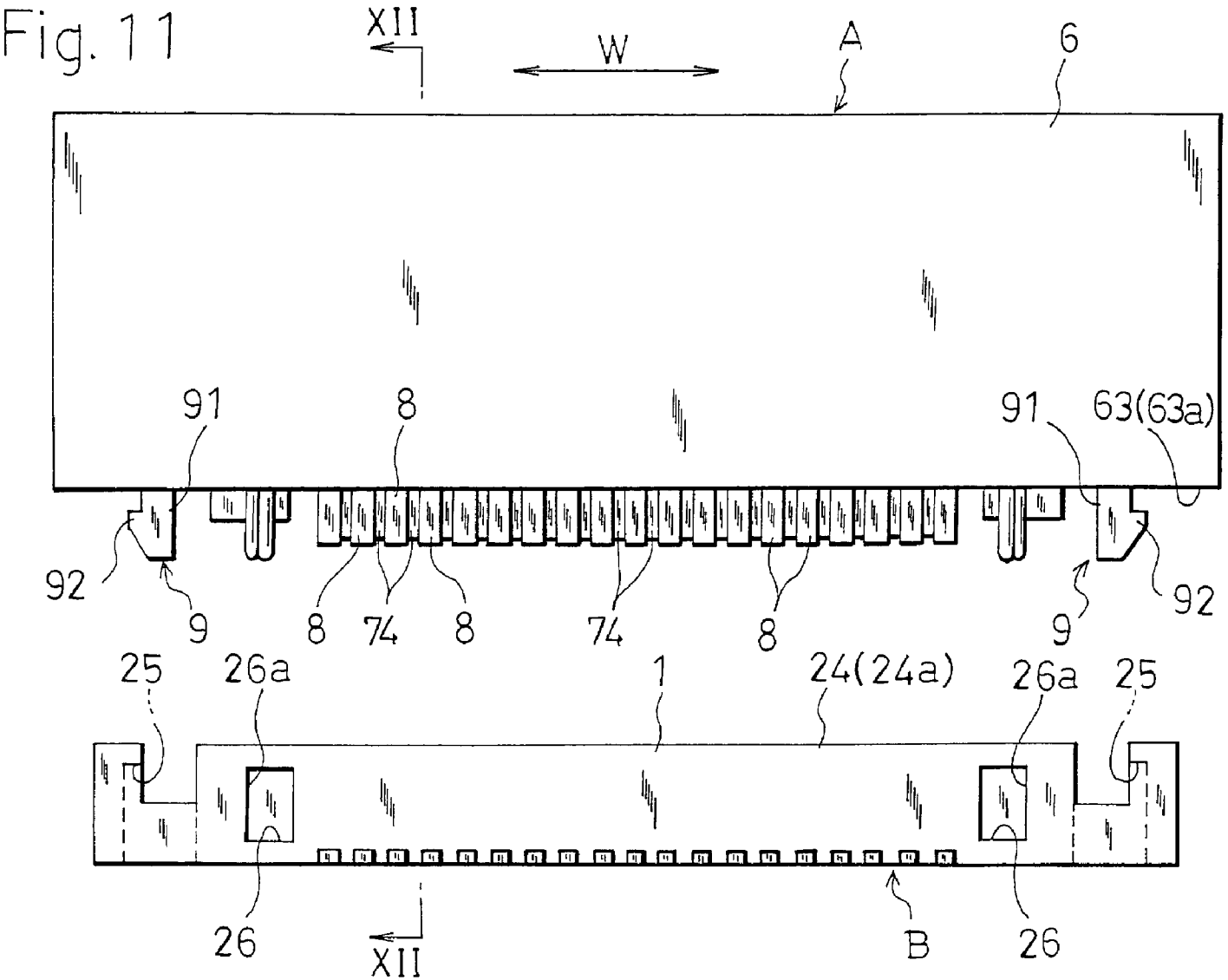
FIG. 11 is a schematic plan view showing separately the connector of the invention and a counter connector.

As shown in FIG. 11, the plug type connector A is formed into a laterally elongates rectangular shape in a plan view. As seen by observing both FIGS. 11 and 12, the whole shape of the plug type connector A is defined by a hollow housing 6 which is formed into a flat box-like shape. In the housing 6, a large number of grooves 62 are formed at regular intervals in the lateral direction, and contact pieces 7 are placed in the grooves 62, respectively. In each of the contact pieces 7, as show in FIG. 12, a wide attaching portion 71 is continuously integrated with the basal portion, and a support rod 72 is projected integrally from the attaching portion 71, so that the support rod 72 is in contact with the inner face of the housing 6 to be backed up. The front end 74 of the contact piece 7 is forward projected in front of a front face 63 of the housing 6, and the contact piece 7 is elastically deformable in the thickness direction of the plug type connector A indicated by the arrow T. A terminal 73 which is formed into a protruding arcuate shape is disposed in the front end 74. Forward protrusion portions 8 are projected integrally from the front face 63 of the housing 6. The protrusion portions 8 are disposed at regular intervals in the lateral direction on the front end face 63 of the housing 6. The front ends 74 of the contact pieces 7 and the terminals 73 are positioned between each pair of adjacent protrusion portions 8. Each of the terminals 73 is projected outside the outer profile line L (see FIG. of a corresponding one of the protrusion portions 8, at a position between the front end 81 of the protrusion portion 8 and the front end face 63 of the housing 6. Therefore, the terminal 73 is projected to one side in the thickness direction T of the housing 6 with respect to the outer profile line L of the protrusion portion 8.

As shown in FIG. 11, an engagement piece 9 is attached to both ends in the lateral (width) direction W of the housing 6. The engagement piece 9 comprises an elastically deformable rod 91 which is projected in front of the front end face 63 of the housing 6, and an engagement claw 92 which is formed integrally with the rod 91. The specific shapes of the protrusion portions 8 and the engagement claws 92 will be described later. The housing 6 is formed into a flat rectangular box-like shape configured by the housing body 64 comprising the grooves 62, and a cover 65 which is coupled to the housing body 64 so as to cover the grooves 62.

The jack type connector B shown in FIGS. 11 and 12 and the like and serving as a counter connector is identical with the connector which has been described with reference to FIGS. 1 to 8. Therefore, the counter connector B is to be incorporated into a portable telephone serving as a mobile terminal device, and used for forming an IO port. The laterally elongated flat hollow housing 1 comprises the engagement face 25 which is to engage with the engagement claw 92 of the plug type connector A to prevent the plug type connector A from slipping off, in each of the lateral ends of the housing. The housing further comprises the recesses 21 (see FIG. 12) which are laterally arranged at regular intervals. The thin plate-like internal terminals 3 which are fitted into the recesses 21, respectively are arranged so as to be overlaid on the inner face of the housing 1 in the thickness direction (which coincides with the thickness direction T of the housing 6).

The insertion/extraction port 20 is opened in a front end of the housing 1, and the shutter 5 is disposed in the insertion/extraction port 20. By the spring member 55 incorporated in the housing 1, the shutter 5 is always elastically urged in the direction along which the insertion/extraction port 20 is closed, and, during the non-use period of the jack type connector B, located at the position where the shutter 5 closes the insertion/extraction port 20. When the terminals 73 of the plug type connector A are inserted into the internal space S1 through the insertion/extraction port 20, the shutter 5 is pushed open by the protrusion portions 8.

Figure 14:
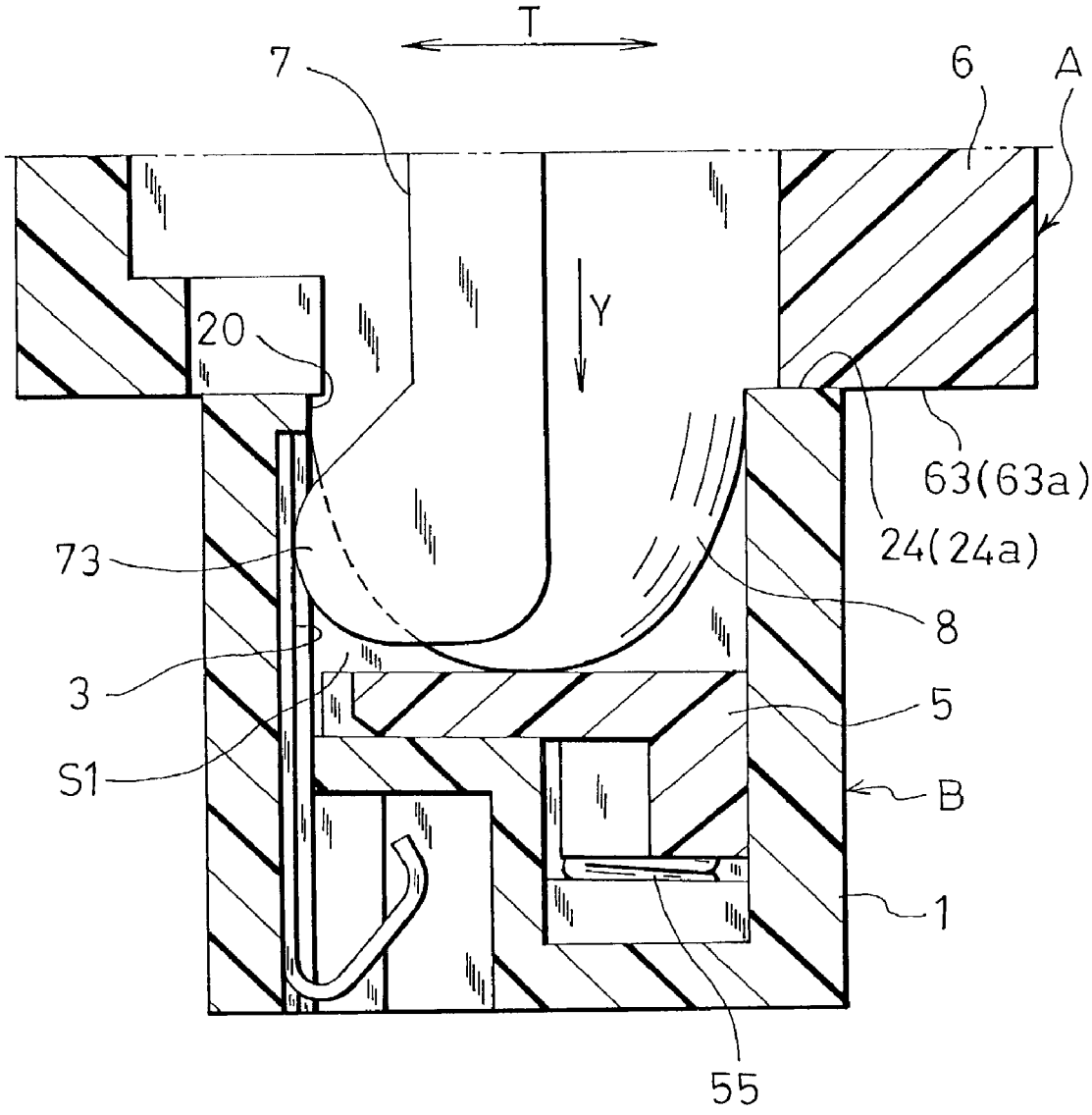
FIG. 14 is a longitudinal section view showing main portions in an enlarged manner and illustrating the function.

When the plug type connector A which has been described is to be coupled to the jack type connector B serving as a counter connector, the terminals 73 and the protrusion portions 8 of the plug type connector A are inserted into the internal space S1 of the jack type connector B through the insertion/extraction port 20 as indicated by the arrow Y in FIG. 14. As a result, the shutter 5 which closes the insertion/extraction port 20 is pushed open by the protrusion portions 8 and is retracted against the urging by the spring member 55, and the terminals 73 are then in contact with the internal terminals 3 of the jack type connector B, respectively. The degree of insertion of the terminals 73 with respect to the internal space S1 of the jack type connector B is restricted by butting of the front end face 63 of the housing 6 against the front face 24 of the housing 1. Therefore, the butting portion 63*a* and the receiving portion 24*a* which butt against each other to restrict the degree of insertion of the terminals 73 are formed by the front end face 63 of the housing 6, and the front face 24 of the housing 1 in which the edge portion of the insertion/extraction port 20 of the jack type connector B is formed, respectively.

Figure 12:
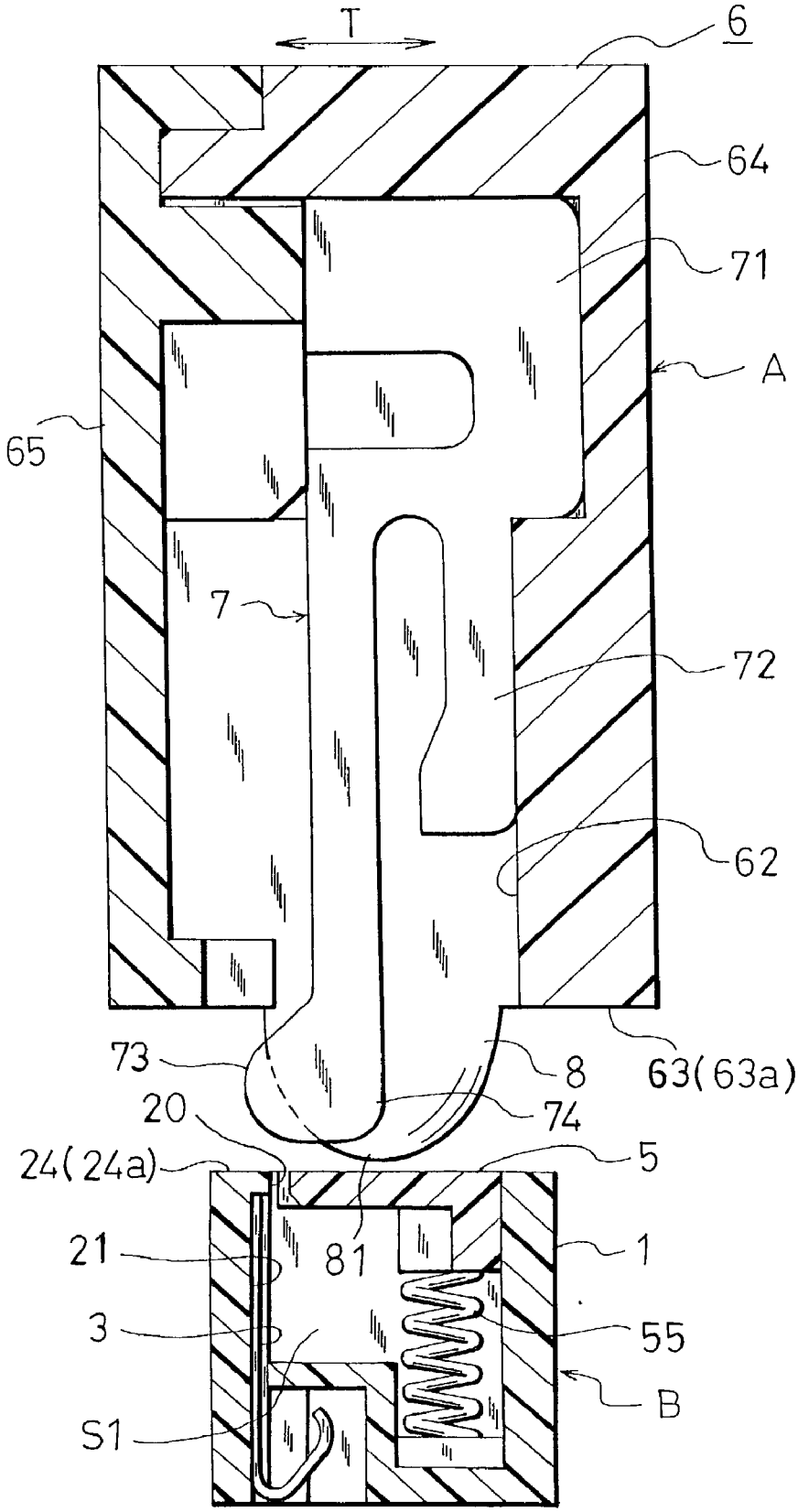
FIG. 12 is a section view showing portions along the line XII-XII of FIG. 11 in an enlarged manner.
Figure 13:
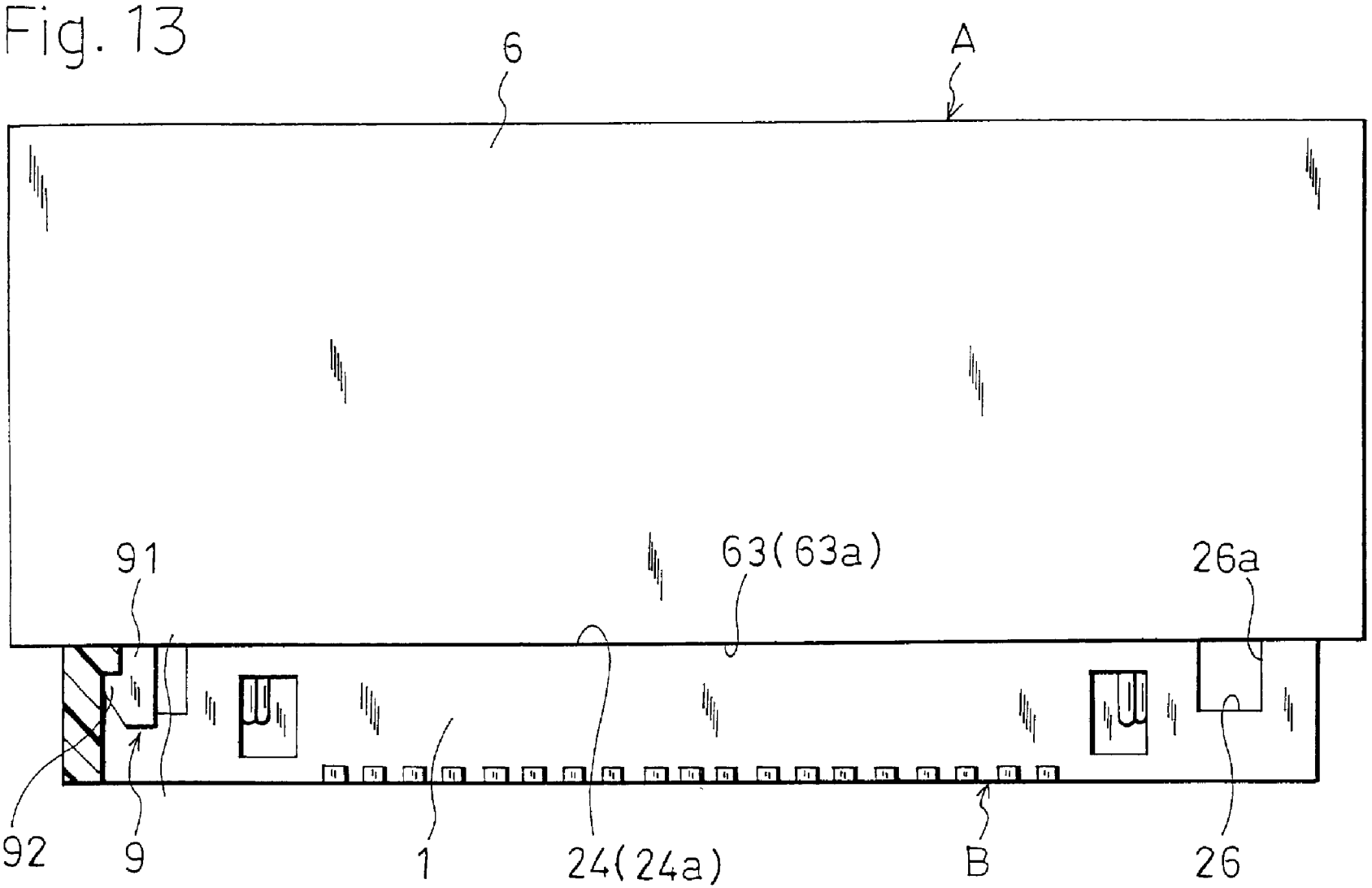
FIG. 13 is a schematic plan view of the connector coupled to the counter connector.
Figure 15:
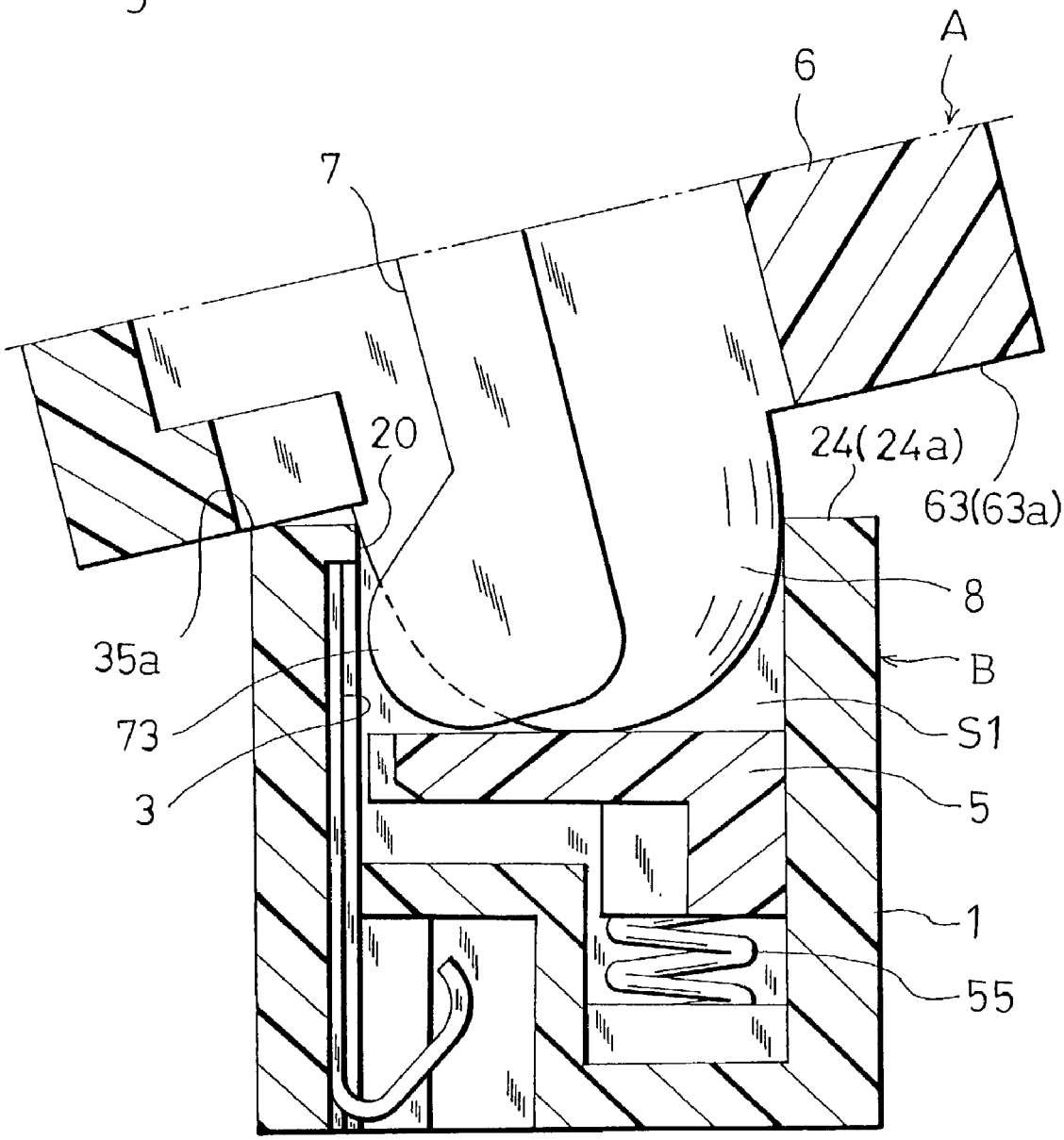
FIG. 15 is a longitudinal section view showing main portions in an enlarged manner in a state where the connector is pried, and illustrating the function.
Figure 16:
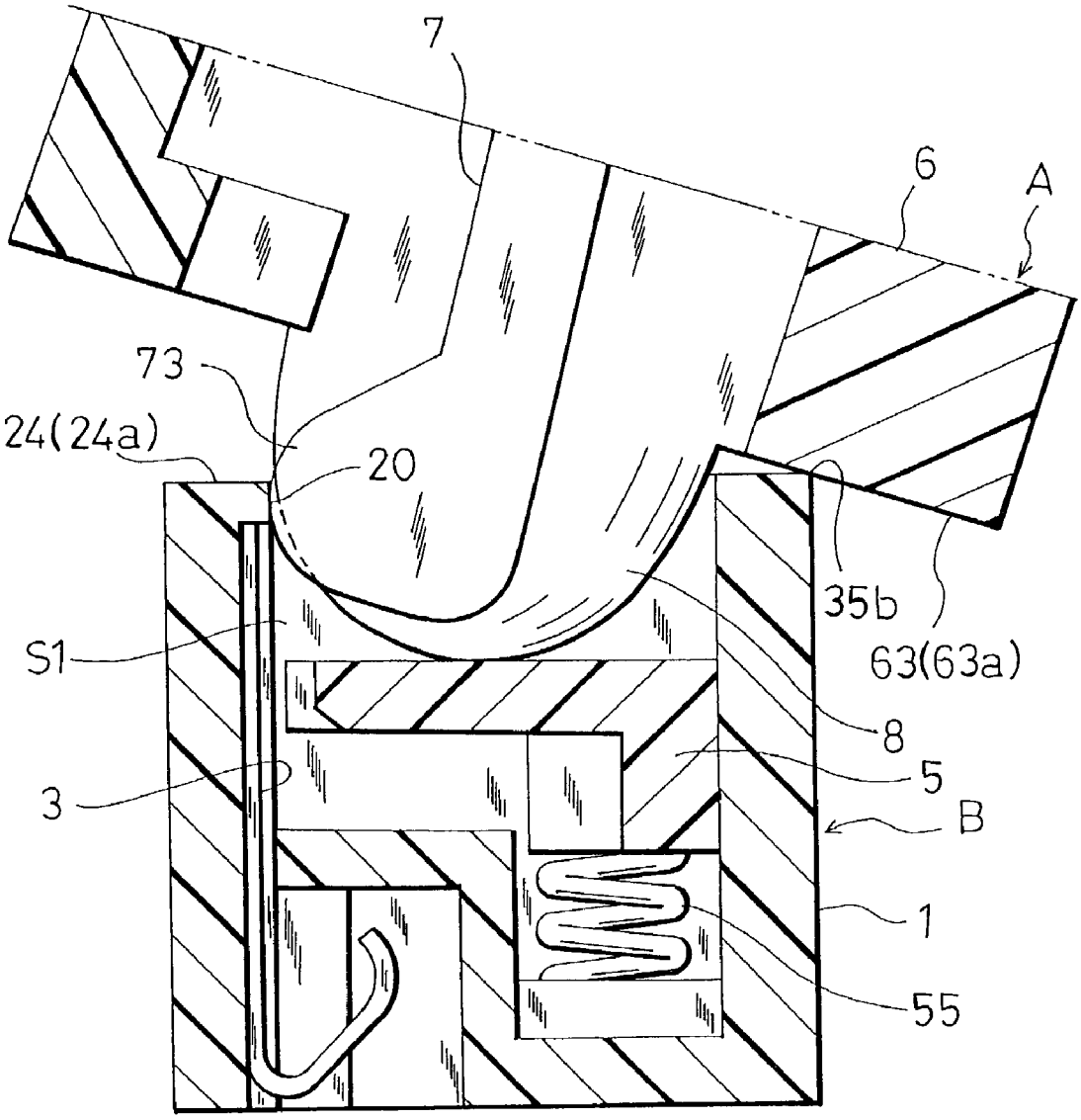
FIG. 16 is a longitudinal section view showing main portions in an enlarged manner in a state where the connector is pried, and illustrating the function.

As seen from FIG. 12, the plug type connector A is thicker than the jack type connector B. When the plug type connector A is coupled to the jack type connector B, therefore, the whole of the receiving portion 24*a* which is the front face 24 of the housing 1 of the jack type connector B butts overlappingly against the butting portion 63*a* which is the front end face 63 of the housing 6 of the plug type connector A, as shown in FIG. 14. When a prying force is applied in the thickness direction T of the plug type connector A, consequently, the plug type connector A is tilted as shown in FIG. 15 with using the position of an outer edge 35*a* on one side in the thickness direction of the front face 24 of the housing 1 of the jack type connector B, as a fulcrum, or the plug type connector A is tilted as shown in FIG. 16 with using the position of an outer edge 35*b* on the other side in the thickness direction of the front face 24 of the housing 1 of the jack type connector B, as a fulcrum. Therefore, the two positions, i.e., the position of the outer edge 35*a* on the one side, and the outer edge 35*b* on the other side of the front face 24 of the housing 1 of the jack type connector B which butts against the front end face 63 of the housing 6 of the plug type connector A can be assumed as the position of the fulcrum of the prying and tilting of the plug type connector A. On the presumption of the above, the shape of the protrusion portions 8 will be described in detail with reference to FIG. 17.

The shape of each of the protrusion portions 8 is determined so that the protrusion portion 8 is positioned inside a virtual circle R1 which is centered at the one fulcrum P1 that is assumed by the position of the outer edge 35*a* on the one side of the housing 1 of the jack type connector B, and which has the radius elongating to an edge 20*a* of the insertion/extraction port 20, the edge being in a remoter side from the position of the one fulcrum, and inside a virtual circle R2 which is centered at the other fulcrum P2 that is assumed by the position of the other outer edge 35*b*, and which has the radius elongating to an edge 20*b* of the insertion/extraction port 20, the edge being in a remoter side from the position of the other fulcrum.

When the shape of the protrusion portions 8 is determined as described with reference to FIG. 17, both in the case where the plug type connector A is pried and tilted as shown in FIG. 15 with using the position of the outer edge 35*a* on the one side in the thickness direction of the front face 24 of the housing 1 of the jack type connector B, as a fulcrum, and the case where the plug type connector A is pried and tilted as shown in FIG. 16 with using the position of the outer edge 35*b* on the other side in the thickness direction of the front face 24 of the housing 1 of the jack type connector B, as a fulcrum, there never occurs a situation in which the protrusion portions 8 forcibly press the peripheral wall faces of the internal space S1 of the jack type connector B, i.e., the inner wall face of the housing 1 and the shutter 5 to change their initial shapes. In other words, the protrusion portions 8 escape to the outside of the internal space S1 through the insertion/extraction port 20 without changing the initial shape of the peripheral wall faces of the internal space S1 of the jack type connector B, and the initial shape of the shutter 5. Even when the plug type connector A is pried, therefore, there arises no possibility that the protrusion portions 8 are damaged or the housing 1 of the jack type connector B is broken.

As described above, the internal terminals 3 of the jack type connector B are arranged so as to be overlaid on the inner face of the housing 1 in the thickness direction of the jack type connector B, and hence the internal terminals 3 are placed outside the loci of movement in which the protrusion portions 8 escape to the outside of the internal space S1 through the insertion/extraction port 20. Therefore, there arises no possibility that the protrusion portions 8 interfere with the internal terminals 3 and the internal terminals 3 or the protrusion portions 8 are broken.

Figure 17:
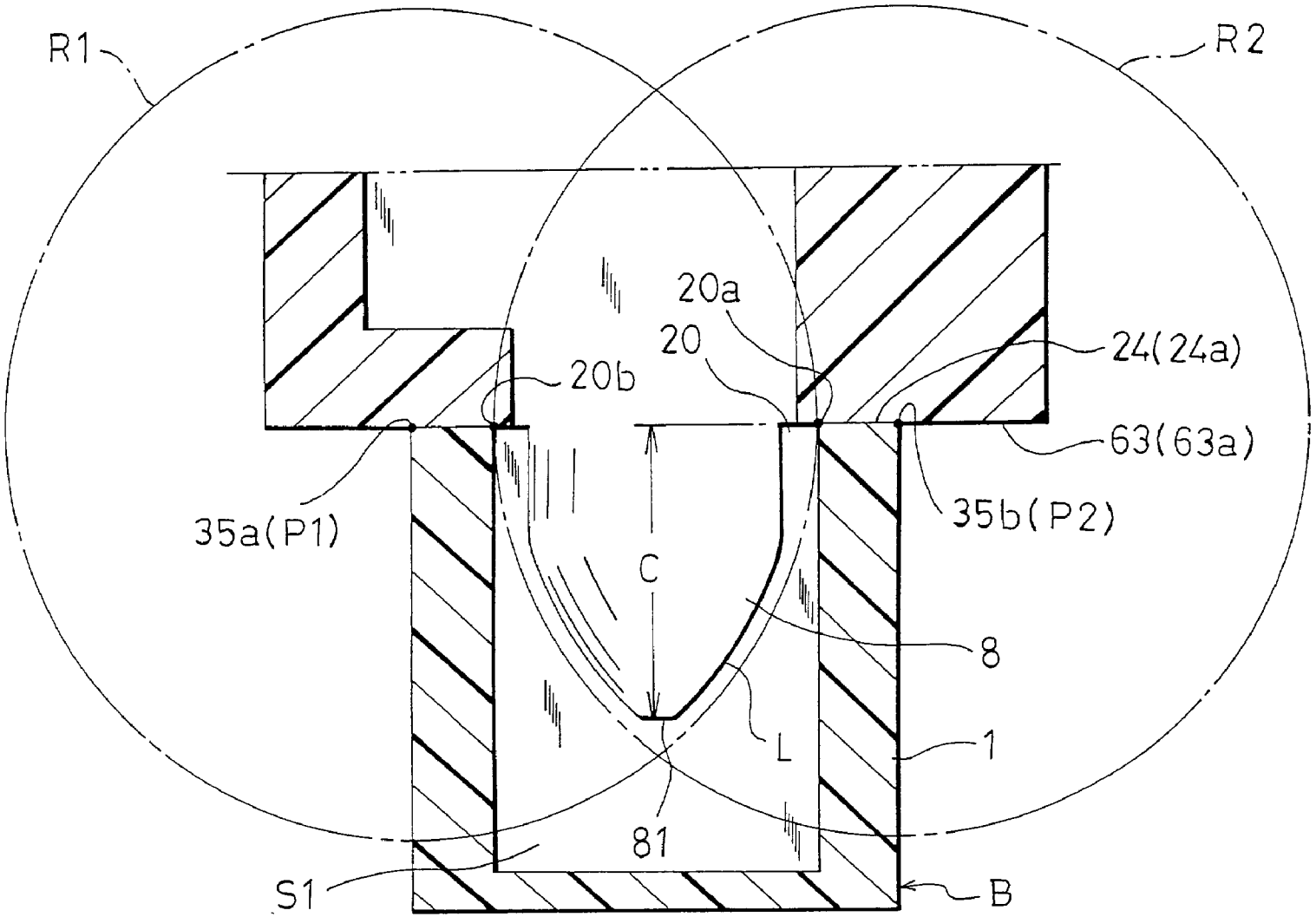
FIG. 17 is a view showing the principle and illustrating conditions which are necessary for performing functions of the invention.

In the embodiment, as shown in principle in FIG. 17, the outer profile line L of each of the protrusion portions 8 has an ovaloid shape which elongates along the two virtual circles R1 and R2 in close proximity to the virtual circles R1 and R2. In the above, "the outer profile line L of each of the protrusion portions 8 has an ovaloid shape which elongates along the virtual circles R1 and R2" means that the outer profile line L of the protrusion portion 8 has a tapered shape which elongates closer to the virtual circles R1 and R2 as approaching nearer to the tip end of the protrusion portion 8. When the shape of the protrusion portions 8 is determined in this way, the projection width C of the protrusion portions 8 from the front end face 63 of the housing 6 can be made as long as possible. Therefore, the projection length of the terminals 73 which are shown in FIG. 14 and the like, from the front end face 63 of the housing 6 can be made large correspondingly with the projection width C, and hence the contact range of the internal terminals 3 of the jack type connector B with respect to the terminals 73 can be prolonged. When the contact range of the internal terminals 3 with respect to the terminals 73 is prolonged, the stability or reliability of the contact between the internal terminals 3 and the terminals 73 is correspondingly improved, and there is a further advantage that, when the terminals 73 are inserted into or extracted from the internal space S1 of the jack type connector B, the rubbing width between the terminals 73 and the internal terminals 3 is increased and the self-cleaning function is correspondingly improved.

Figure 18:
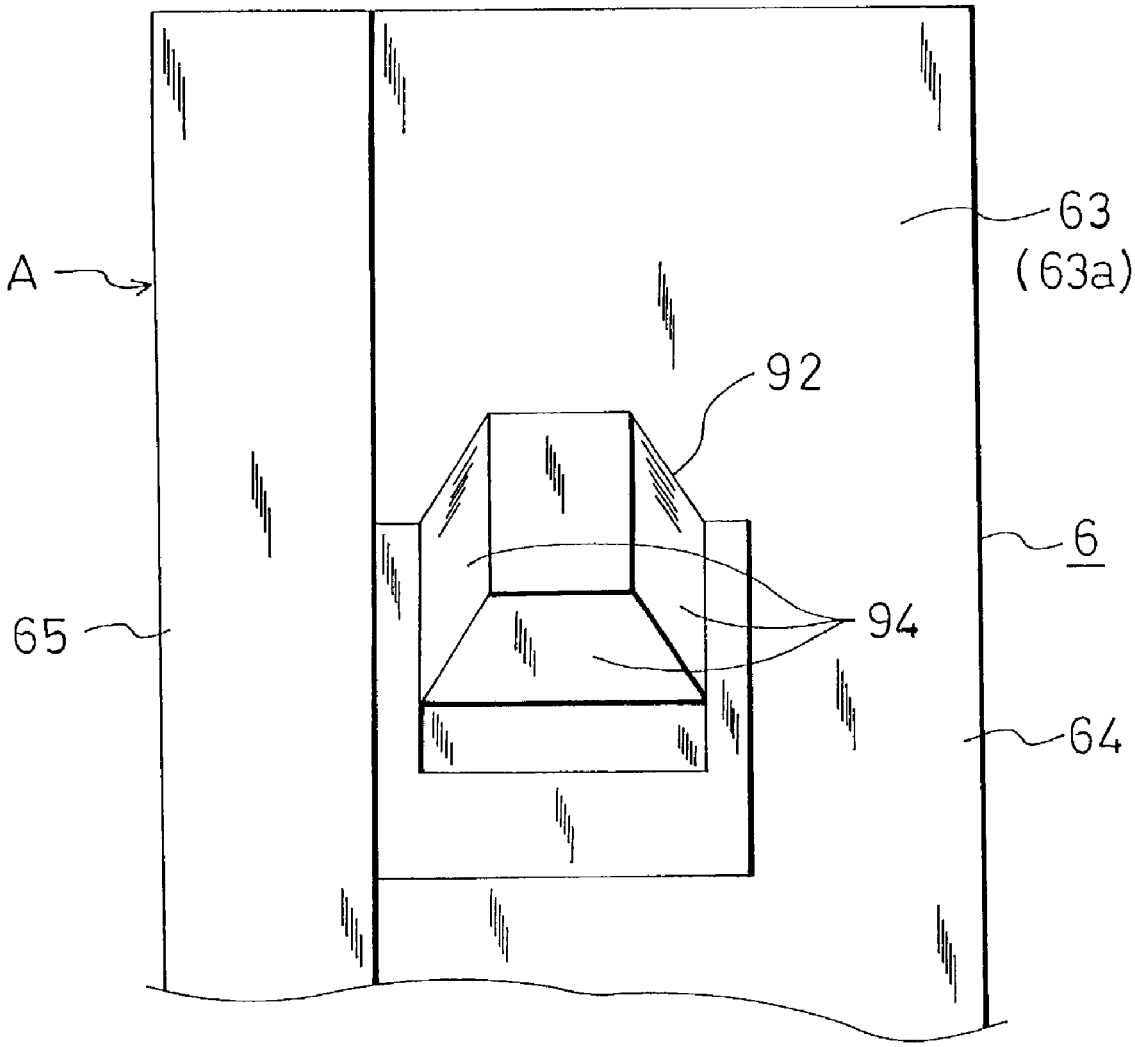
FIG. 18 is a schematic plan view showing an engagement claw in an enlarged manner.
Figure 19:
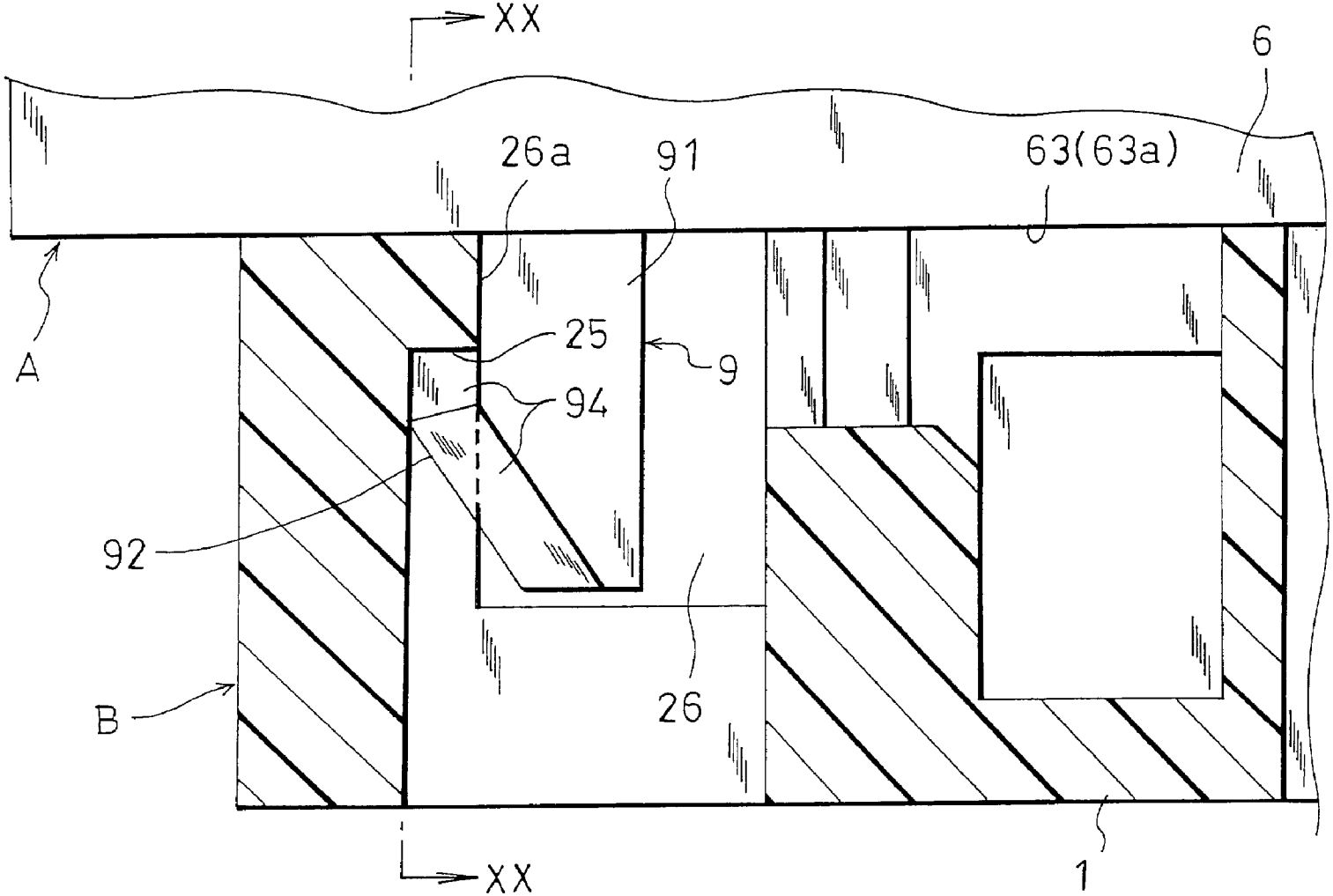
FIG. 19 is a partially cutaway plan view showing an engagement state between the engagement claw and an engagement face.
Figure 20:
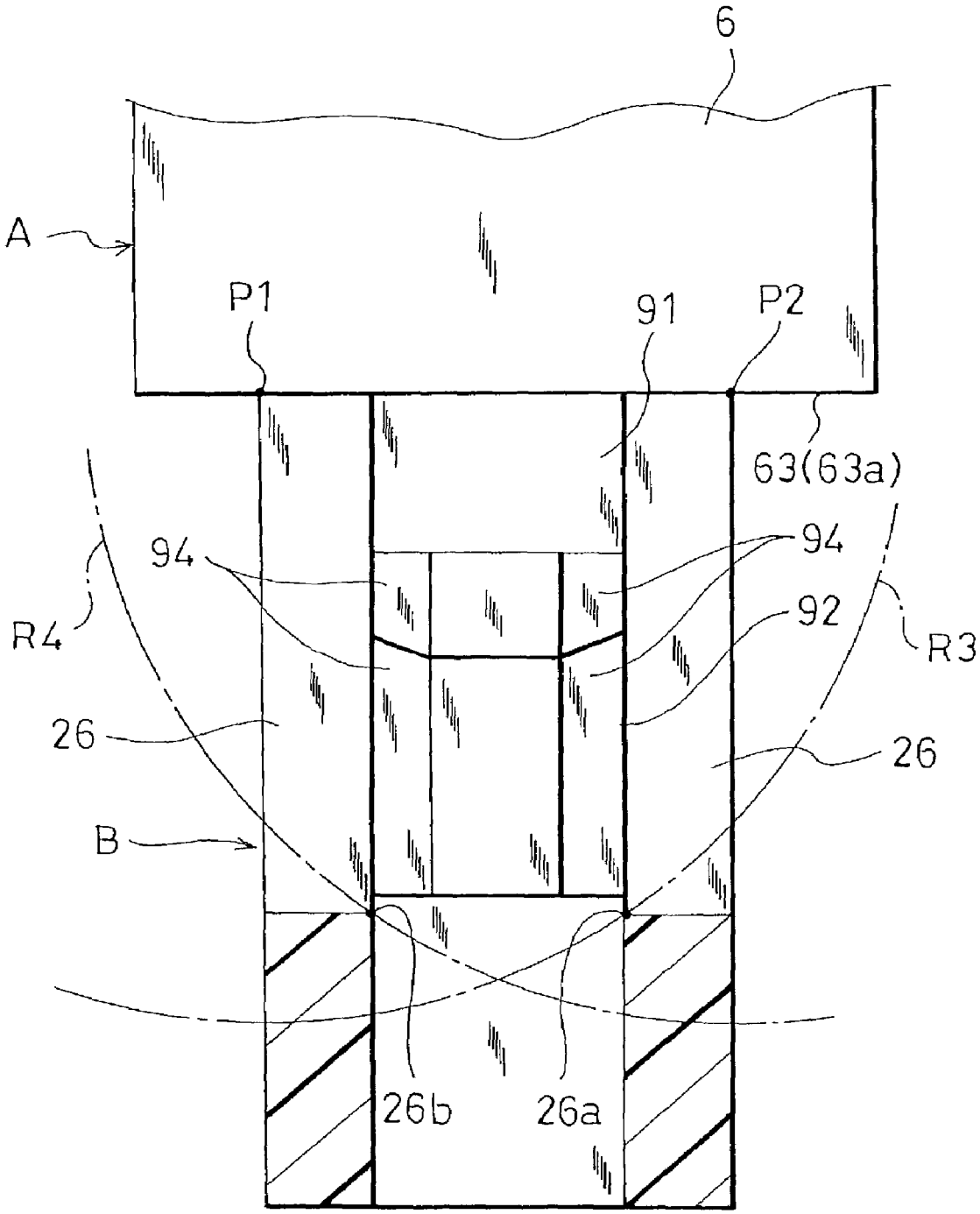
FIG. 20 is a partially cutaway plan view showing portions along the line XX-XX of FIG. 19.

As shown in FIGS. 18 to 20, the engagement claw 92 is projected to the lateral side of the rod 91, and provided with inclined guide faces 94 around the engagement claw to be formed into a tapered shape. By contrast, relief recesses 26 are formed in the jack type connector B. When the plug type connector A is pried and tilted in the thickness direction T, the locus of movement of the engagement claw 92 in which the engagement with the engagement face 25 is canceled is inside the relief recesses 26. The inclined guide faces 94 have an inclination which allows the faces to slide over an edge 26*a* of corresponding one of the relief recesses 26 to override the edge 26*a*. When the plug type connector A is pried and tilted in the thickness direction T, therefore, the engagement between the engagement claw 92 and the engagement face 25 is canceled without effort, and the engagement claw 92 then escapes from the relief recess 26 to the outside. Therefore, the coupling between the plug type connector A and the jack type connector B is canceled to prevent them from being damaged.

FIG. 20 shows a virtual circle R3 which is centered at the one fulcrum P1, and which has the radius elongating to the edge 26*a* of the relief recess 26, the edge being in a remoter side from the position of the fulcrum on the one side, and a virtual circle R4 which is centered at the other fulcrum P2, and which has the radius elongating to the edge 26*b* of the relief recess 26, the edge being in a remoter side from the position of the fulcrum on the other side. The virtual circles are indicated by one-dot chain lines. In the case where the shape of the engagement claw 92 is determined so that the engagement claw 92 is inside the virtual circles R3 and R4, the locus of movement of the engagement claw 92 in which the engagement with the engagement face 25 is canceled is inside the relief recesses 26.

The entire disclosure of Japanese Patent Application No. 2001-213537 filed on Jul. 13, 2001 including specification, claims, drawings and summary are incorporated herein by reference in its entirety.

The entire disclosure of Japanese Patent Application No. 2001-219700 filed on Jul. 19, 2001 including specification, claims, drawings and summary are incorporated herein by reference in its entirety.

What is claimed is:

1. A plug type connector having:

terminals which are to be inserted into an internal space of a jack type connector that are elongated laterally and serve as a counter connector, through an insertion/extraction port that is elongated laterally and has a rectangular shape, whereby said terminals are caused to be respectively in contact with said internal terminals of said jack type connector;

a butting portion which butts against a receiving portion of said jack type connector to restrict a degree of insertion of said terminals with respect to said internal space; and protrusion portions which project in front of said terminals, and which, when said terminals are inserted into said internal space of said jack type connector through said insertion/extraction port, push open a shutter which closes said insertion/extraction port of said jack type connector, wherein said protrusion portions have a shape which, in accordance with a tilting motion of said plug type connector, caused by prying said plug type connector in a thickness direction, allows said protrusion portions to escape to the outside of said internal space through said insertion/extraction port without changing an initial shape of peripheral wall faces of said internal space, and an initial shape of said shutter which is opened by said protrusion portions, and said internal terminals of said jack type connector are placed outside loci of movement in which said protrusion portions escape to the outside of said internal space through said insertion/extraction port.

2. A plug type connector according to claim 1, wherein said insertion/extraction port of said jack type connector is opened in a front end of said housing of said jack type connector, said receiving portion is formed by a front end face of said housing, said front end face forming an edge portion of said insertion/extraction port, said butting portion is formed by a front end face of said plug type connector, and, when said plug type connector is pried in the thickness direction under a state where said butting portion butts against said receiving portion, said plug type connector is tilted with using one place of butting areas between said butting portion and said receiving portion as a fulcrum, said one place being in the thickness direction of said plug type connector, and a shape of said protrusion portions which are inserted into said internal space of said jack type connector to push open said shutter is determined so that said protrusion portions are positioned inside a virtual circle which is centered at the fulcrum, and which has a radius elongating from a position of the fulcrum to an edge of said insertion/extraction port, said edge being in a remoter side from the position of the fulcrum.

3. A plug type connector according to claim 2, wherein a position of each outer edge on both sides in a thickness direction of said front end face of said jack type connector which butts against a rectangular and laterally elongating front end face of a housing of said plug type connector is assumed as the position of the fulcrum of the prying and tilting of said plug type connector, and a shape of said protrusion portions is determined so that said protrusion portions are positioned inside a virtual circle which is centered at one fulcrum that is assumed by the position of the one of the outer edges on both the sides in the thickness direction, and which has a radius elongating to said edge of said insertion/extraction port, said edge being in a remoter side from the position of the one fulcrum, and inside a virtual circle which is centered at another fulcrum that is assumed by the position of the other outer edge, and which has a radius elongating to said edge of said insertion/extraction port, said edge being in a remoter side from the position of the other fulcrum.

4. A plug type connector according to claim 3, wherein:

an outer profile line of each of said protrusion portions has an ovaloid shape which elongates along said two virtual circles.

5. A plug type connector according to claim 4, wherein:

contact pieces are incorporated in said housing of said plug type connector, said terminals which are formed into a protruding arcuate shape are disposed in front ends of said contact pieces, respectively, each of said terminals is projected outside the outer profile line of corresponding ones of said protrusion portions, between said front end face of said housing of said plug type connector, and a front end of said protrusion portion, and said internal terminals of said jack type connector are arranged so as to be overlaid on an inner face of said housing of said jack type connector in the thickness direction of said jack type connector.

6. A plug type connector according to claim 5, wherein:

said contact pieces are elastically deformable in the thickness direction of said plug type connector.

7. A plug type connector according to claim 1, wherein:

said housing of said jack type connector, and said housing of said plug type connector are provided with an engagement claw and an engagement face, respectively, said engagement claw and said engagement face engaging with each other when said butting portion butts against said receiving portion, the engagement between said engagement claw and said engagement face being canceled in accordance with separation of said butting portion from said receiving portion, and, when said plug type connector is pried and tilted in the thickness direction, a locus of movement of said engagement claw in which the engagement with said engagement face is canceled is inside relief recesses which are formed on both sides of said engagement face, respectively.

8. A plug type connector according to claim 7, wherein:

said engagement claw is disposed at a tip end of an elastically deformable rod which is disposed on said housing of said plug type connector, and said engagement claw comprises an inclined guide face which slides over an edge of one of said relief recesses to override said edge.

9. A jack type connector with a shutter, comprising:

a housing which has an insertion/extraction port for a plug type connector serving as a counter connector, and which accommodates a large number of internal terminals that are to be in contact with terminals of the plug type connector inserted into said insertion/extraction port; and a shutter which is closed and opened in an internal space of said housing and between a closing position where said shutter closes said insertion/extraction port, and an opening position where said shutter opens said insertion/extraction port, wherein said connector has:

said shutter which is electrically conductive;

means for always elastically urging said shutter toward the closing position; and a grounding contact piece which is disposed in said housing so that, when said shutter is at the closing position, a butting portion constituting a part of said shutter is in contact with said grounding contact piece, and, when said shutter is opened from the closing position toward the opening position, said butting portion separates from said grounding contact piece, and wherein said housing is formed into a box-like hollow shape which is elongated laterally, a large number of recesses are laterally arranged in plural places of a bottom wall of said housing, each of said recesses is surrounded by a front ridge which is disposed in a front edge of said bottom wall, and which is elongated laterally, and right and left side ridges which elongate from said front ridge toward a rear side of said bottom wall, said internal terminals are accommodated in said recesses, respectively, and upper end faces of said front ridge and said side ridges are higher in level than upper faces of said internal terminals.

10. A jack type connector with a shutter according to claim 9, wherein said grounding contact piece is accommodated in said housing.

11. A jack type connector with a shutter according to claim 9, wherein said shutter is integrally molded by an electrically conductive resin material.

12. A jack type connector with a shutter according to claim 9, wherein said shutter is longitudinally movably accommodated in said housing, directions of opening and closing said shutter coincide respectively with longitudinal directions of said housing, and a spring member which always elastically urges said shutter toward the closing position is interposed between said shutter and a rear end wall of said housing.

13. A jack type connector with a shutter according to claim 9, wherein said grounding contact piece is formed by a shield case which is placed outside said housing to cover said housing, said shutter is formed by a shutter body which is configured by a resin molded product, and a metal sheet which is attached to a front face of said shutter body, and said butting portion is provided in said metal sheet.

14. A jack type connector with a shutter, comprising:

a housing which has an insertion/extraction port for a plug type connector serving as a counter connector, and which accommodates a large number of internal terminals that are to be in contact with terminals of the plug type connector inserted into said insertion/extraction port; and a shutter which is closed and opened in an internal space of said housing and between a closing position where said shutter closes said insertion/extraction port, and an opening position where said shutter opens said insertion/extraction port, wherein said connector has:

said shutter which is electrically conductive;

means for always elastically urging said shutter toward the closing position; and a grounding contact piece which is disposed in said housing so that, when said shutter is at the closing position, a butting portion constituting a part of said shutter is in contact with said grounding contact piece, and, when said shutter is opened from the closing position toward the opening position, said butting portion separates from said grounding contact piece, and wherein said shutter is integrally molded by an electrically conductive resin material, and wherein a protrusion for ensuring a gap space between a lower end edge of said shutter and said internal terminals projects from said lower end edge of said shutter, or a front ridge.

15. A jack type connector with a shutter, comprising:

a housing which has an insertion/extraction port for a plug type connector serving as a counter connector, and which accommodates a large number of internal terminals that are to be in contact with terminals of the plug type connector inserted into said insertion/extraction port; and a shutter which is closed and opened in an internal space of said housing and between a closing position where said shutter closes said insertion/extraction port, and an opening position where said shutter opens said insertion/extraction port, wherein said connector has:

said shutter which is electrically conductive;

means for always elastically urging said shutter toward the closing position; and a grounding contact piece which is disposed in said housing so that, when said shutter is at the closing position, a butting portion constituting a part of said shutter is in contact with said grounding contact piece, and, when said shutter is opened from the closing position toward the opening position, said butting portion separates from said grounding contact piece, and wherein a plate-like conductor is accommodated in a recess which is formed in a wall face of a lateral end portion of said housing, said grounding contact piece which projects upward in said recess is formed integrally with a front end portion of said conductor, an engagement claw which, when said shutter is at the closing position, is engaged with a rear end face of said grounding contact piece is disposed on a lateral end portion of said shutter, said engagement claw separating from said rear end face of said grounding contact piece when said shutter is opened from the closing position toward the opening position, and an engagement/disengagement portion of said engagement claw with respect to said rear end face of said grounding contact piece is formed as said butting portion.

* * * * *